US005839526A

United States Patent [19]

Cisneros et al.

[11] Patent Number: 5,839,526

[45] Date of Patent: Nov. 24, 1998

[54] ROLLING CONE STEEL TOOTH BIT WITH ENHANCEMENTS IN CUTTER SHAPE AND PLACEMENT

[75] Inventors: Dennis Cisneros, Kingwood; Scott D. McDonough, Houston; James C. Minikus, Spring; Chris E. Cawthorne, The Woodlands, all of Tex.

[73] Assignee: Smith International, Inc., Houston, Tex.

[21] Appl. No.: 833,418

[22] Filed: Apr. 4, 1997

[51] Int. Cl.[6] ..... E21B 10/16

[52] U.S. Cl. ..... 175/431; 175/378

[58] Field of Search ..... 175/374, 375, 175/426, 431, 378

[56] References Cited

U.S. PATENT DOCUMENTS

| | | | |
|---|---|---|---|
| 930,759 | 8/1909 | Hughes . | |
| 1,325,944 | 12/1919 | Hughes . | |
| 1,480,014 | 1/1924 | Scott . | |
| 2,104,822 | 1/1938 | Scott | 255/71 |
| 2,203,846 | 6/1940 | Stancliff | 175/375 |
| 2,244,617 | 6/1941 | Hannum | 255/71 |
| 2,333,746 | 11/1943 | Scott et al. | 255/71 |
| 2,363,202 | 11/1944 | Scott | 255/71 |
| 2,527,838 | 10/1950 | Morlan et al. . | |
| 2,660,405 | 11/1953 | Scott et al. | 255/347 |
| 2,774,570 | 12/1956 | Cunningham | 255/347 |
| 2,804,282 | 8/1957 | Spengler, Jr. | 255/345 |
| 2,851,253 | 9/1958 | Boice | 255/347 |
| 2,887,302 | 5/1959 | Garner | 255/349 |
| 2,907,551 | 10/1959 | Peter | 255/349 |
| 2,927,777 | 3/1960 | Steen | 255/347 |
| 2,927,778 | 3/1960 | Coulter, Jr. | 255/349 |
| 2,939,684 | 6/1960 | Payne | 255/349 |
| 2,990,025 | 6/1961 | Talbert et al. | 175/375 |
| 3,003,370 | 10/1961 | Coulter, Jr. et al. | 76/108 |
| 3,018,835 | 1/1962 | Kucera | 175/378 |
| 3,104,726 | 9/1963 | Davis | 175/331 |
| 3,126,067 | 3/1964 | Schumacher, Jr. | 175/374 |
| 3,223,188 | 12/1965 | Coulter, Jr. et al. | 175/341 |
| 3,389,761 | 6/1968 | Ott | 175/374 |
| 3,401,759 | 9/1968 | White | 175/341 |
| 3,504,751 | 4/1970 | Agoshashvilli et al. | 175/331 |
| 3,743,038 | 7/1973 | Bennett | 175/341 |
| 4,086,973 | 5/1978 | Keller et al. | 175/374 |
| 4,262,761 | 4/1981 | Crow | 175/374 |

(List continued on next page.)

OTHER PUBLICATIONS

Liang, D.B., M.K. Keshavan and S.D. McDonough, "The Development of Improved Soft Formation Milled Tooth Bits," *Proceedings of the SPE/IADC Drilling Conference held Feb.* 23–25, 1993, *Amsterdam*, pp. 605–614.

Smith International, Inc. internal documents; Exhibit A comprises drawings of certain cutter inserts that were included on drill bits sold before Apr. 4, 1997; Exhibit B includes a drawing of a cutter insert that was included on drill bits sold before Apr. 4, 1997; (*See accompanying IDS*).

*Primary Examiner*—Frank Tsay
*Attorney, Agent, or Firm*—Conley, Rose & Tayon, P.C.

[57] ABSTRACT

A steel tooth bit includes one or more rolling cone cutters having a generally conical surface, a heel surface, and preferably a transition surface therebetween. A row of gage cutter elements are secured to the cone cutter on the transition surface and have cutting surfaces that cut to full gage. A first inner row of off-gage steel teeth is positioned on the conical surface of the cone cutter so that the gage-facing cutting surfaces of the teeth are close to gage, but are preferably off-gage a distance D at a knee that is formed on the gage facing surface. Distance D is strategically selected such that the gage and off-gage cutter elements cooperatively cut the corner of the borehole. The lower most portion of the gage facing surface of these steel teeth are off gage a distance D' which is greater than D so as to bring the cutting tip of the teeth off gage to prevent undesired wear and rounding off of the tip of the cutter element. The upper most portion of the gage-facing surface is also preferably off gage a distance D" that is greater than D so as to optimize the surface area on the gage facing surface that is in contact with the borehole corner.

66 Claims, 20 Drawing Sheets

U.S. PATENT DOCUMENTS

| | | | |
|---|---|---|---|
| 4,343,371 | 8/1982 | Baker, III et al. | 175/329 |
| 4,420,050 | 12/1983 | Jones | 175/374 |
| 4,604,106 | 8/1986 | Hall et al. | 51/293 |
| 4,629,373 | 12/1986 | Hall | 407/118 |
| 4,694,918 | 9/1987 | Hall | 175/329 |
| 4,716,977 | 1/1988 | Huffstutler | 175/410 |
| 4,726,432 | 2/1988 | Scott et al. | 175/375 |
| 4,811,801 | 3/1989 | Salesky et al. | 175/329 |
| 4,832,139 | 5/1989 | Minikus et al. | 175/374 |
| 4,836,307 | 6/1989 | Keshavan et al. | 175/374 |
| 5,027,913 | 7/1991 | Nguyen | 175/336 |
| 5,051,112 | 9/1991 | Keshavan et al. | 51/309 |
| 5,131,480 | 7/1992 | Lockstedt et al. | 175/374 |
| 5,145,016 | 9/1992 | Estes | 175/331 |
| 5,152,194 | 10/1992 | Keshavan et al. | 76/108.2 |
| 5,172,777 | 12/1992 | Siracki et al. | 175/374 |
| 5,172,779 | 12/1992 | Siracki et al. | 175/420 |
| 5,197,555 | 3/1993 | Estes | 175/431 |
| 5,201,376 | 4/1993 | Williams | 175/374 |
| 5,287,936 | 2/1994 | Grimes et al. | 175/331 |
| 5,311,958 | 5/1994 | Isbell et al. | 175/341 |
| 5,322,138 | 6/1994 | Siracki | 175/374 |
| 5,323,865 | 6/1994 | Isbell et al. | 175/378 |
| 5,341,890 | 8/1994 | Cawthorne et al. | 175/374 |
| 5,346,026 | 9/1994 | Pessier et al. | 175/331 |
| 5,351,768 | 10/1994 | Scott et al. | 175/374 |
| 5,351,769 | 10/1994 | Scott et al. | 175/374 |
| 5,351,770 | 10/1994 | Cawthorne et al. | 175/374 |
| 5,351,771 | 10/1994 | Zahradnik | 175/374 |
| 5,353,885 | 10/1994 | Hooper et al. | 175/378 |
| 5,407,022 | 4/1995 | Scott et al. | 175/331 |
| 5,415,244 | 5/1995 | Portwood | 175/374 |
| 5,421,424 | 6/1995 | Portwood et al. | 175/374 |
| 5,445,231 | 8/1995 | Scott et al. | 175/374 |
| 5,456,327 | 10/1995 | Denton et al. | 175/371 |
| 5,479,997 | 1/1996 | Scott et al. | 175/374 |
| 5,492,186 | 2/1996 | Overstreet et al. | 175/374 |
| 5,542,485 | 8/1996 | Pessier | 175/371 |
| 5,579,856 | 12/1996 | Bird | 175/375 |
| 5,592,995 | 1/1997 | Scott et al. | 175/374 |
| 5,697,462 | 12/1997 | Grimes et al. | 175/374 |

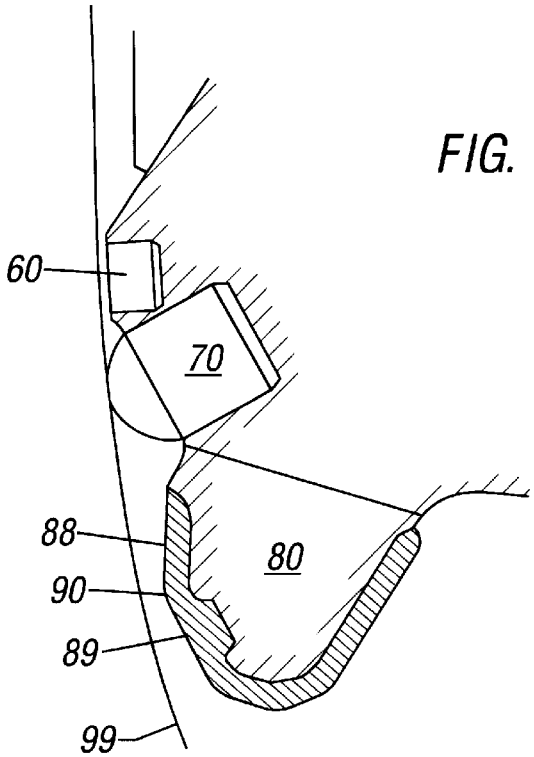
FIG. 9
FIG. 10
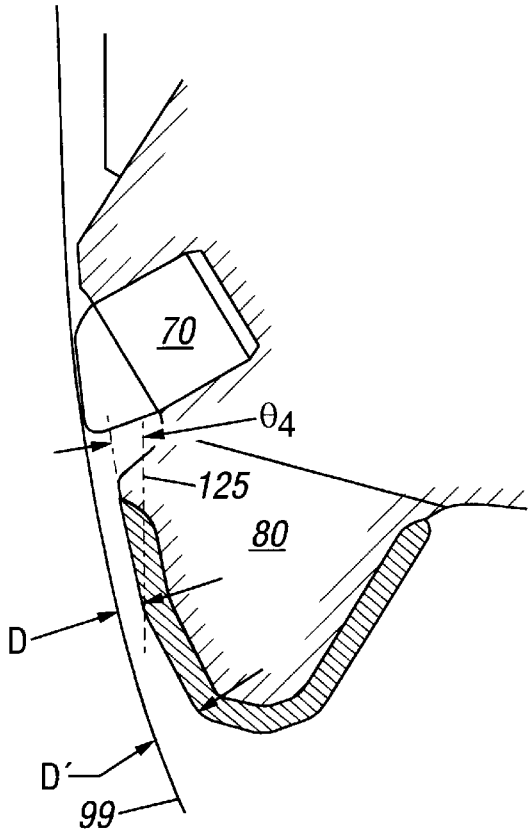

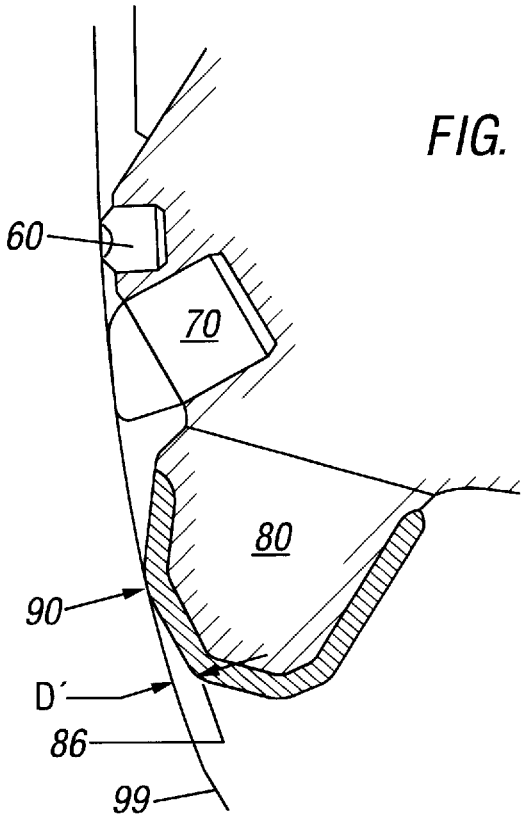
FIG. 11
FIG. 12A
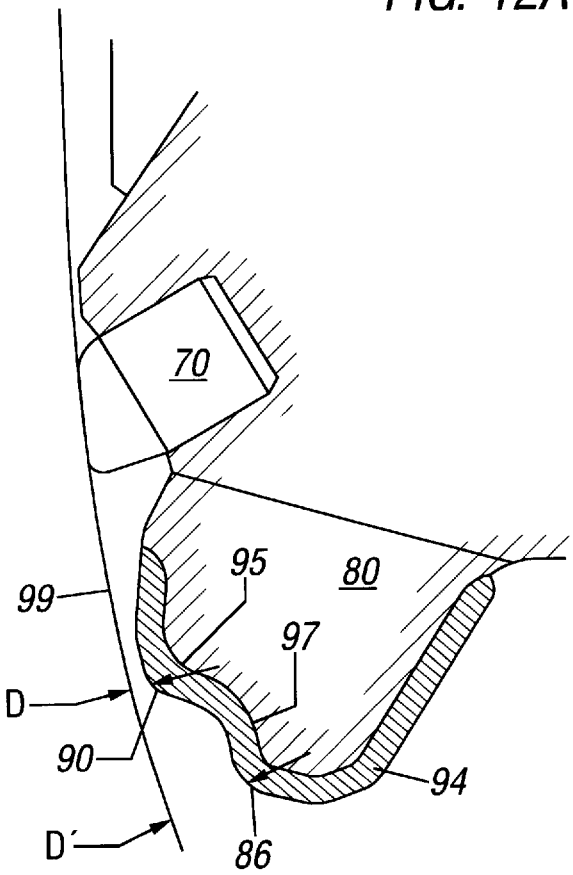

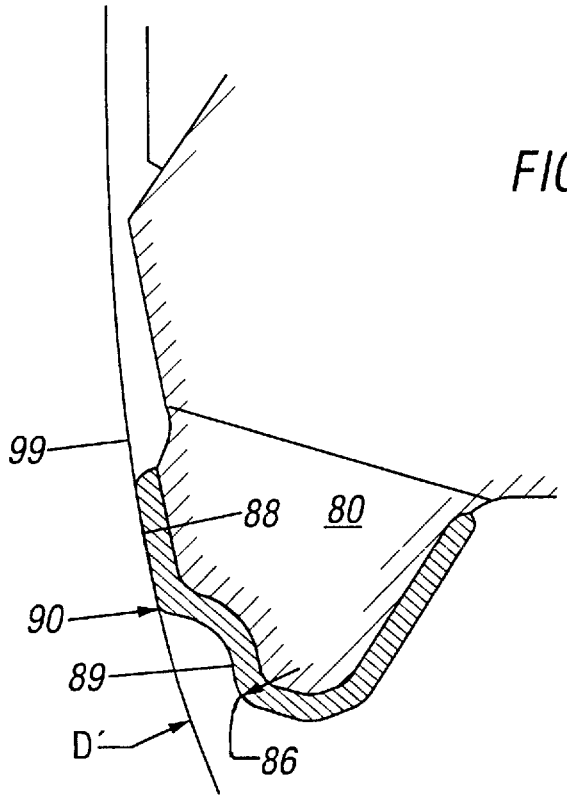
FIG. 12B
FIG. 13A
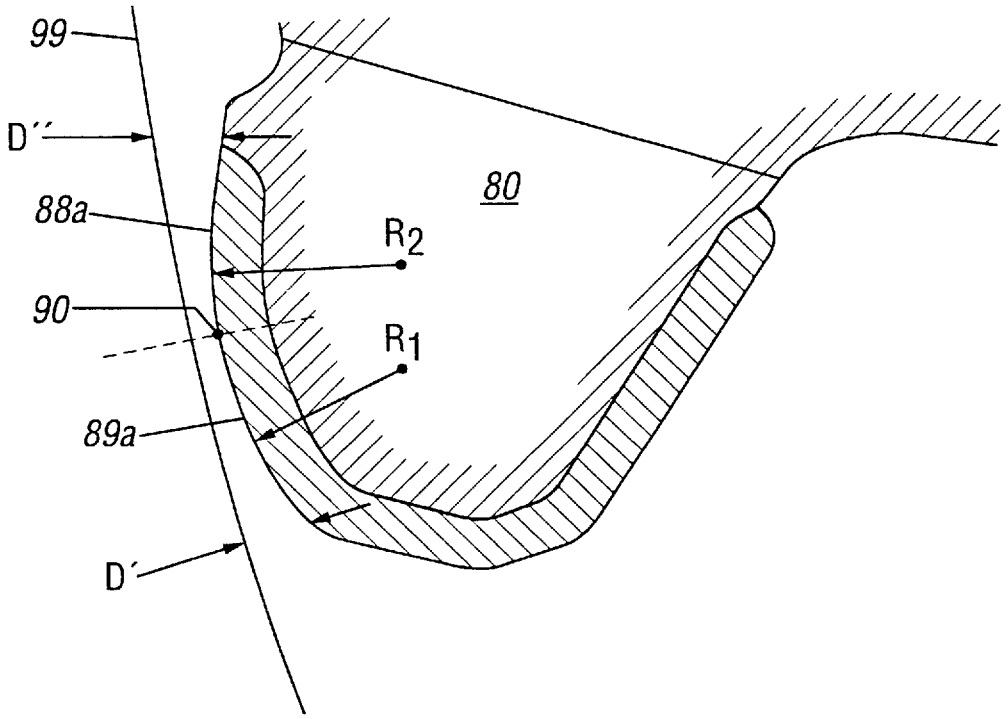

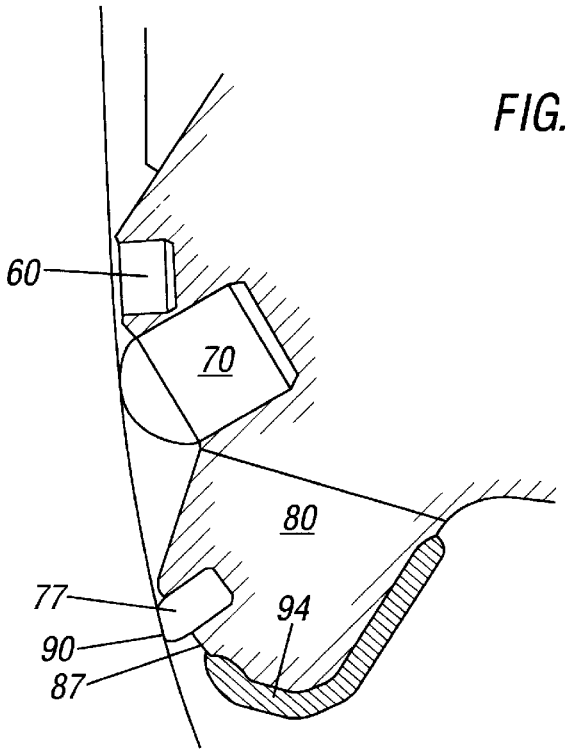
FIG. 13F
FIG. 14A
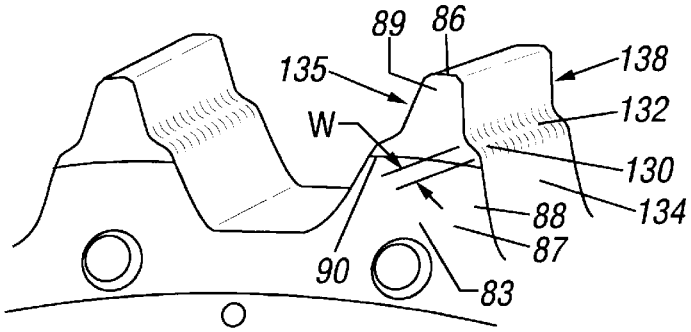
FIG. 14B
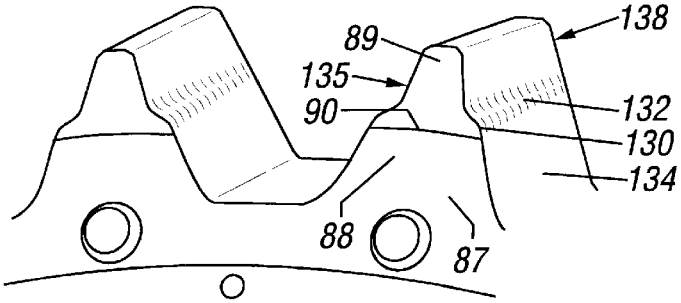

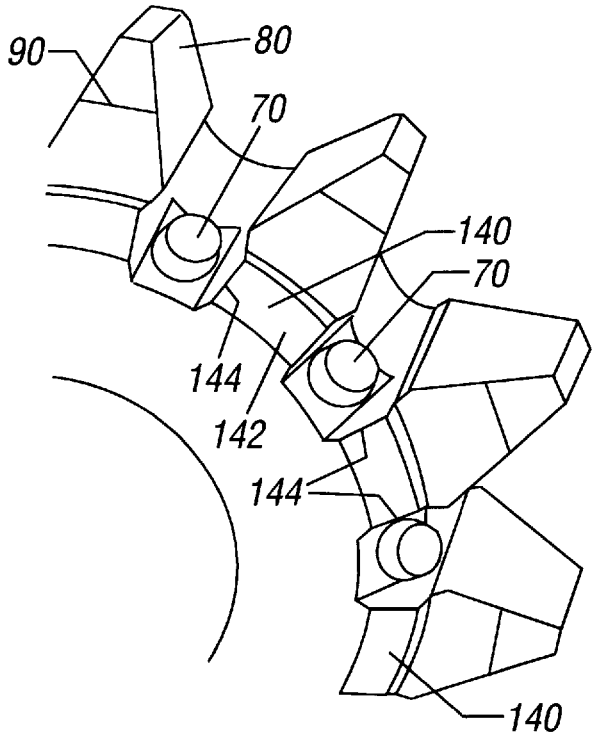
FIG. 22A
FIG. 22B
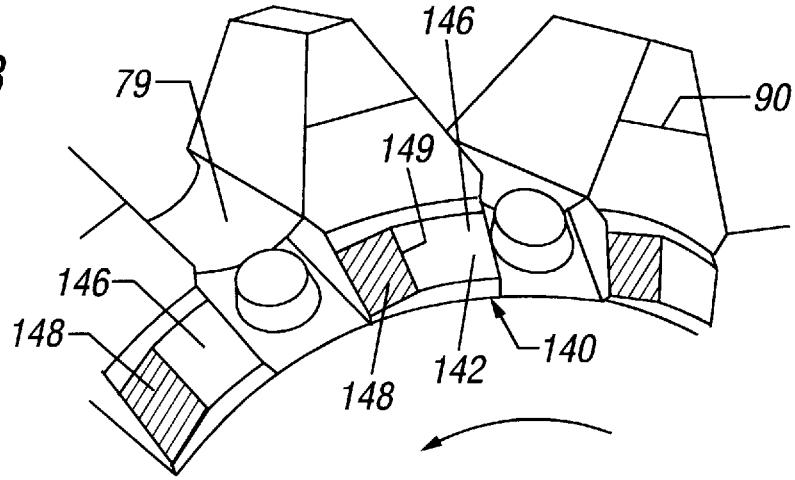

ROLLING CONE STEEL TOOTH BIT WITH ENHANCEMENTS IN CUTTER SHAPE AND PLACEMENT

FIELD OF THE INVENTION

The invention relates generally to earth-boring bits used to drill a borehole for the ultimate recovery of oil, gas or minerals. More particularly, the invention relates to rolling cone rock bits and to an enhanced cutting structure for such bits. Still more particularly, the invention relates to novel cutter elements and the placement of those cutter elements on the rolling cone cutters to increase bit durability and rate of penetration and enhance the bit's ability to maintain gage.

BACKGROUND OF THE INVENTION

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit.

A typical earth-boring bit includes one or more rotatable cutters that perform their cutting function due to the rolling movement of the cutters acting against the formation material. The cutters roll and slide upon the bottom of the borehole as the bit is rotated, the cutters thereby engaging and disintegrating the formation material in its path. The rotatable cutters may be described as generally conical in shape and are therefore sometimes referred to as rolling cones. Such bits typically include a bit body with a plurality of journal segment legs. The cone cutters are mounted on bearing pin shafts which extend downwardly and inwardly from the journal segment legs. The borehole is formed as the gouging and scraping or crushing and chipping action of the rotary cones remove chips of formation material which are carried upward and out of the borehole by drilling fluid which is pumped downwardly through the drill pipe and out of the bit. The drilling fluid carries the chips and cuttings in a slurry as it flows up and out of the borehole.

The earth disintegrating action of the rolling cone cutters is enhanced by providing the cutters with a plurality of cutter elements. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits, while those having teeth formed from the cone material are known as "steel tooth bits." In each case, the cutter elements on the rotating cutters functionally breakup the formation to form new borehole by a combination of gouging and scraping or chipping and crushing.

The cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer and which are usable over a wider range of formation hardness.

The length of time that a drill bit may be employed before it must be changed depends upon its rate of penetration ("ROP"), as well as its durability or ability to maintain an acceptable ROP. The form and positioning of the cutter elements (both steel teeth and TCI inserts) upon the cone cutters greatly impact bit durability and ROP and thus are critical to the success of a particular bit design.

Bit durability is, in part, also measured by a bit's ability to "hold gage," meaning its ability to maintain a full gage borehole diameter over the entire length of the borehole. Gage holding ability is particularly vital in directional drilling applications which have become increasingly important. If gage is not maintained at a relatively constant dimension, it becomes more difficult, and thus more costly, to insert drilling apparatus into the borehole than if the borehole had a constant diameter. For example, when a new, unworn bit is inserted into an undergage borehole, the new bit will be required to ream the undergage hole as it progresses toward the bottom of the borehole. Thus, by the time it reaches the bottom, the bit may have experienced a substantial amount of wear that it would not have experienced had the prior bit been able to maintain full gage. This unnecessary wear will shorten the bit life of the newly-inserted bit, thus prematurely requiring the time consuming and expensive process of removing the drill string, replacing the worn bit, and reinstalling another new bit downhole.

To assist in maintaining the gage of a borehole, conventional rolling cone bits typically employ a heel row of hard metal inserts on the heel surface of the rolling cone cutters. The heel surface is a generally frustoconical surface and is configured and positioned so as to generally align with and ream the sidewall of the borehole as the bit rotates. The inserts in the heel surface contact the borehole wall with a sliding motion and thus generally may be described as scraping or reaming the borehole sidewall. The heel inserts function primarily to maintain a constant gage and secondarily to prevent the erosion and abrasion of the heel surface of the rolling cone. Excessive wear of the heel inserts leads to an undergage borehole, decreased ROP, increased loading on the other cutter elements on the bit, and may accelerate wear of the cutter bearing and ultimately lead to bit failure.

In addition to the heel row inserts, conventional bits typically include a gage row of cutter elements mounted adjacent to the heel surface but oriented and sized in such a manner so as to cut the corner of the borehole. In this orientation, the gage cutter elements generally are required to cut both the borehole bottom and sidewall. The lower surface of the gage cutter elements engage the borehole bottom while the radially outermost surface scrapes the sidewall of the borehole. Conventional bits also include a number of additional rows of cutter elements that are located on the cones in rows disposed radially inward from the gage row. These cutter elements are sized and configured for cutting the bottom of the borehole and are typically described as inner row cutter elements.

Differing forces are applied to the cutter elements by the sidewall than the borehole bottom. Thus, requiring the gage cutter elements to cut both portions of the borehole compromises the cutter element's design. In general, the cutting action operating on the borehole bottom is predominantly a crushing or gouging action, while the cutting action operating on the sidewall is a scraping or reaming action. Ideally, a crushing or gouging action requires a cutter element made of a tough material, one able to withstand high impacts and compressive loading, while the scraping or reaming action calls for a very hard and wear resistant material. One grade of steel or tungsten carbide cannot optimally perform both of these cutting functions as it cannot be as hard as desired for cutting the sidewall and, at the same time, as tough as desired for cutting the borehole bottom. As a result, compromises have been made in conventional bits such that the gage row cutter elements are not as tough as the inner row of cutter elements because they must, at the same time, be harder, more wear resistant and less aggressively shaped so as to accommodate the scraping action on the sidewall of the borehole.

The rolling cone cutters of conventional steel tooth bits include circumferential rows of radially-extending teeth. In such bits, it is common practice to include a gage row of steel teeth employed both to cut the borehole corner and to ream the sidewall. A known improvement to this bit design is to include a heel row of hard metal inserts to assist in reaming the borehole wall. A cone cutter 114 of such a prior art bit 110 is generally shown in FIG. 1 having gage row teeth 112 and heel row inserts 116. As shown, the gage row teeth 112 include a gage facing surface 113 and a bottom facing surface 115 at the tip of the tooth 112. When the cone cutter 114 has been rotated such that a given gage row tooth 112 is in position to engage the formation as shown in FIG. 1, gage facing surface 113 generally faces and acts against the borehole sidewall 5, while bottom facing surface 115 at the tip of the tooth 112 acts against the bottom of the borehole.

Because the tooth 112 works against the borehole bottom, it is desirable that it be made of a material having a toughness suitable of withstanding the substantial impact loads experienced in bottom hole cutting. At the same time, however, a significant portion of the tooth's gage facing surface 113, works against the sidewall of the borehole where it was subject to severe abrasive wear. Because tooth 112 cuts the corner of the borehole and thereby is required to perform both sidewall and bottom hole cutting duties, a compromise has had to be made in material toughness and wear resistance. Consequently, in use, the tooth 112 has tended to wear into a rounded configuration as the portion of the gage facing surface 113 closest to the tip of the tooth 112 wears due to sidewall abrasion and bottom hole impact. This rounding off of tooth 112 has tended to reduce the ROP of the bit 110 and also tended ultimately to lead to an undergage borehole.

More specifically, as gage row teeth 112 begin to round off, the heel row inserts 116 are initially capable of maintaining the full gage diameter of the borehole. However, as the heel inserts are called upon to cut increasingly more and more of the formation material as the teeth 112 are rounded off further, the heel inserts themselves experience faster wear and breakage. Ultimately, the bit's ability to maintain gage is lost.

In prior art bits like that shown in FIG. 1, breakage or wear of heel inserts 116 leads to an undergage condition and accelerates the bit's loss of ROP as described above. This can best be understood with reference to FIGS. 2A–C which schematically shows the relationship of conventional heel insert 116 with respect to the borehole wall 5 as the insert performs its scraping or reaming function. These Figures show the direction of the cutter element movement relative to the borehole wall 5 as represented by arrow 109, this movement being referred to hereinafter as the "cutting movement" of the cutter element. This cutting movement 109 is defined by the geometric parameters of the static cutting structure design (including parameters such as cone diameter, bit offset, and cutter element count and placement), as well as the cutter element's dynamic movement caused by the bit's rotation, the rotation of the cone cutter, and the vertical displacement of the bit through the formation.

As shown in FIG. 2A, as the cutting surface of insert 116 first approaches and engages the hole wall, the formation applies forces inducing primarily compressive stresses in the leading portion of the insert as represented by arrow 119. As the cone rotates further, the leading portion of insert 116 leaves engagement with the formation and the trailing portion of the insert comes into contact with the formation as shown in FIG. 2C. This causes a reaction force from the hole wall to be applied to the trailing portion of the insert, as represented by arrow 120 (FIG. 2C), which produces tensile stress in the insert. With insert 116 in the position shown in FIG. 2C, it can be seen that the trailing portion of the insert, the portion which experiences significant tensile stress, is not well supported. That is, there is only a relatively small amount of supporting material behind the trailing portion of the insert that can support the trailing portion to reduce the deformation and hence the tensile stresses, and buttress the trailing portion. As such, the produced tensile stress will many times be of such a magnitude so as to cause the trailing section of the heel inserts 116 to break or chip away. This is especially the case with inserts that are coated with a layer of super abrasive, such as polycrystalline diamond (PCD), which is known to be relatively weak in tension. Breakage of the trailing portion or loss of the highly wear resistant super abrasive coating, or both, leads to further breakage and wear, and thus accelerates the loss of the bit's ability to hold gage.

Accordingly, there remains a need in the art for a steel tooth drill bit and cutting structure that is more durable than those conventionally known and that will yield greater ROP's and an increase in footage drilled while maintaining a full gage borehole. Preferably, the bit and cutting structure would not require the compromises in cutter element toughness, wear resistance and hardness which have plagued conventional bits and thereby limited durability and ROP.

SUMMARY OF THE INVENTION

The present invention provides a steel tooth bit for drilling a borehole of a predetermined gage, the bit providing increased durability, ROP and footage drilled (at full gage) as compared with similar bits of conventional technology. The bit includes a bit body and one or more rolling cone cutters rotatably mounted on the bit body. The rolling cone cutter includes a generally conical surface, a heel surface, and preferably a transition surface therebetween. A row of gage cutter elements are secured to the cone cutter on the transition surface and have cutting surfaces that cut to full gage. The bit further includes a first inner row of off-gage steel teeth positioned on the conical surface of the cone cutter so that their gage-facing cutting surfaces are close to gage, but are preferably off-gage by a distance D at a knee formed on the gage facing surface. Distance D is strategically selected such that the gage and off-gage cutter elements cooperatively cut the corner of the borehole. Preferably, the lower most portion of the gage facing surface of these steel teeth are off gage a distance D' which is greater than D so as to bring the cutting tip of the teeth off gage to prevent undesired wear and rounding off of the tip of the cutter element which causes reduced ROP. Likewise, the upper most portion of the gage-facing surface is also preferably off gage a distance D" that is greater than D so as to optimize the surface area on the gage facing surface that is in contact with the borehole corner, and also to enhance the ability of the drilling fluid to clean the cutter elements as desirable for optimum ROP.

According to the invention, the first inner row of off-gage steel teeth are milled, cast, or otherwise integrally formed from the cone material. The off-gage distance D may be the same for all the cone cutters on the bit, or may vary between the various cone cutters in order to achieve a desired balance of durability and wear characteristics for the cone cutters. The gage row cutter elements may be hard metal inserts having specifically shaped and oriented cutting surfaces or may be steel teeth coated with abrasion resistant material. The gage row cutter elements preferably are mounted along the transition surface of the cone.

The invention permits dividing the borehole corner cutting load among the gage row cutter elements and the first inner row of off-gage teeth such that the lower portion or tip of the first inner row of off gage teeth primarily cut the bottom of the borehole, while the gage cutter elements and the knee formed on the gage facing surface of the off gage teeth primarily cut the borehole sidewall. This positioning enables the cutter elements to be optimized in terms of materials, shape, and orientation so as to enhance ROP, bit durability and footage drilled at full gage.

BRIEF DESCRIPTION OF THE DRAWINGS

For an introduction to the detailed description of the preferred embodiments of the invention, reference will now be made to the accompanying drawings, wherein:

FIGS. 9–11 and 12A, 12B are views similar to FIG. 6 showing further alternative embodiments of the invention.

FIGS. 13A–13D are views similar to FIG. 6 showing alternative embodiments of the present invention.

FIGS. 13E and 13F are views similar to FIG. 6 showing alternative embodiments of the invention in which a hard metal insert forms a knee on the gage facing surface of a cutter element.

FIG. 14A and 14B are perspective views of a portion of a rolling cone cutter including steel teeth configured in accordance with further embodiments of the invention.

FIG. 22A is a partial perspective view of an alternative embodiment of the present invention.

FIG. 22B is a partial perspective view similar to FIG. 22A showing another alternative embodiment of the present invention.

DETAILED DESCRIPTION OF THE PREFERRED EMBODIMENTS

Figure 3:
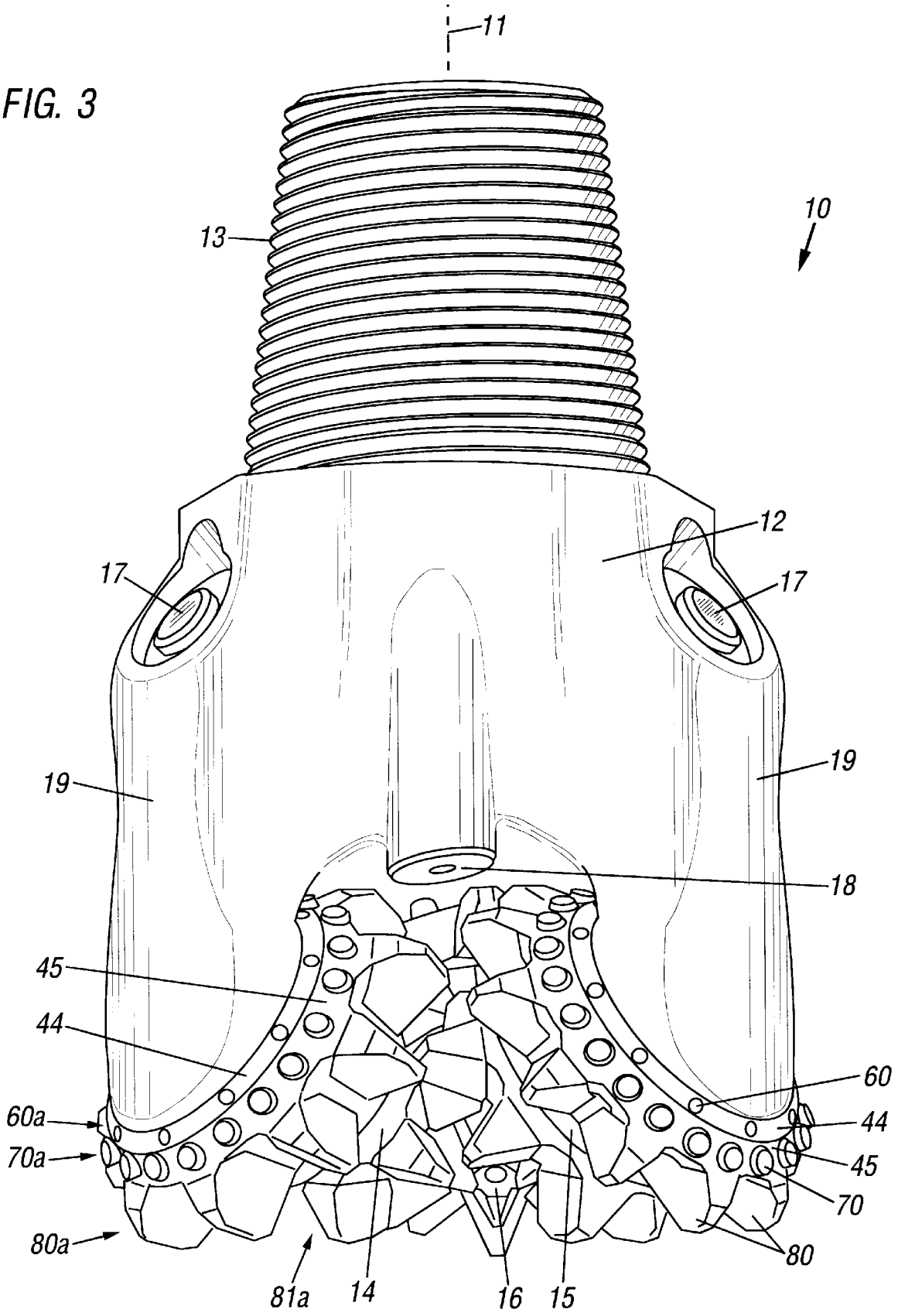
FIG. 3 is a perspective view of an earth-boring bit made in accordance with the principles of the present invention.

Referring to FIG. 3, an earth-boring bit 10 made in accordance with the present invention includes a central axis 11 and a bit body 12 having a threaded section 13 on its upper end for securing the bit to the drill string (not shown). Bit 10 has a predetermined gage diameter as defined by three rolling cone cutters 14, 15, 16 which are rotatably mounted on bearing shafts that depend from the bit body 12. Bit body 12 is composed of three sections or legs 19 (two shown in FIG. 3) that are welded together to form bit body 12. Bit 10 further includes a plurality of nozzles 18 that are provided for directing drilling fluid toward the bottom of the borehole and around cutters 14–16. Bit 10 further includes lubricant reservoirs 17 that supply lubricant to the bearings of each of the cone cutters.

Figure 4:
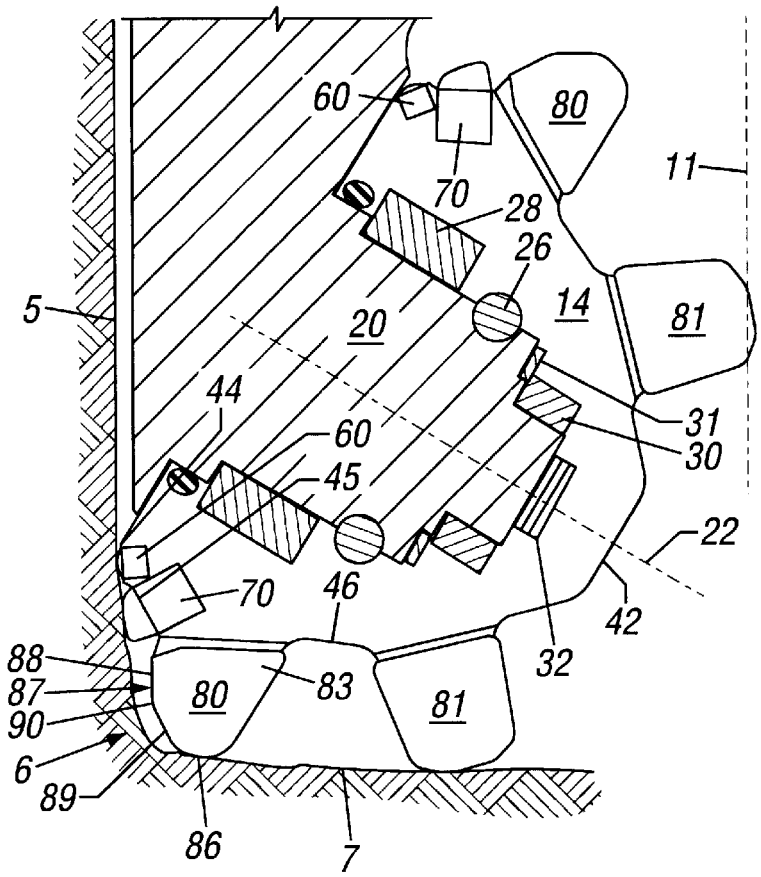
FIG. 4 is a partial section view taken through one leg and one rolling cone cutter of the bit shown in FIG. 3.

Referring now to FIG. 4, in conjunction with FIG. 3, each cone cutter 14–16 is rotatably mounted on a pin or journal 20, with an axis of rotation 22 orientated generally downwardly and inwardly toward the center of the bit. Drilling fluid is pumped from the surface through fluid passage 24 where it is circulated through an internal passageway (not shown) to nozzles 18 (FIG. 3). Each cutter 14–16 is typically secured on pin 20 by locking balls 26. In the embodiment shown, radial and axial thrust are absorbed by roller bearings 28, 30, thrust washer 31 and thrust plug 32; however, the invention is not limited to use in a roller bearing bit, but may equally be applied in a friction bearing bit. In such instances, the cones 14, 15, 16 would be mounted on pins 20 without roller bearings 28, 30. In both roller bearing and friction bearing bits, lubricant may be supplied from reservoir 17 to the bearings by conventional apparatus that is omitted from the figures for clarity. The lubricant is sealed and drilling fluid excluded by means of an annular seal 34. The borehole created by bit 10 includes sidewall 5, corner portion 6 and bottom 7, best shown in FIG. 4.

Referring still to FIGS. 3 and 4, each cone cutter 14–16 includes a backface 40, a nose portion 42 that is spaced apart from backface 40, and surfaces 44, 45 and 46 formed between backface 40 and nose 42. Surface 44 is generally frustoconical and is adapted to retain hard metal inserts 60 that scrape or ream the sidewalls of the borehole as cutters 14–16 rotate about the borehole bottom. Frustoconical surface 44 will be referred to herein as the "heel" surface of cutters 14–16, it being understood, however, that the same surface may be sometimes referred to by others in the art as the "gage" surface of a rolling cone cutter. Cone cutters 14–16 are affixed on journals 20 such that, at its closest approach to the borehole wall, heel surface 44 generally faces the borehole sidewall 5. Transition surface 45 is a frustoconical surface adjacent to heel surface 44 and generally tapers inwardly and away from the borehole sidewall. Retained in transition surface 45 are hard metal gage inserts 70. Extending between transition surface 45 and nose 42 is a generally conical surface 46 having circumferential rows of steel teeth that gouge or crush the borehole bottom 7 as the cone cutters rotate about the borehole.

Further features and advantages of the present invention will now be described with reference to cone cutter 14, cone cutters 15, 16 being similarly, although not necessarily identically, configured. Cone cutter 14 includes a plurality of heel row inserts 60 that are secured in a circumferential heel row 60*a* in the frustoconical heel surface 44, and a circumferential row 70*a* of gage inserts 70 secured to cutter 14 in transition surface 45. Inserts 60, 70 have generally cylindrical base portions that are secured by interference fit into mating sockets drilled into cone cutter 14, and cutting portions connected to the base portions having cutting surfaces that extend from surfaces 44 and 45 for cutting formation material. Cutter 14 further includes a plurality of radially-extending steel teeth 80, 81 integrally formed from the steel of cone cutter 14 and arranged in spaced-apart inner rows 80*a*, 81*a* respectively. Heel inserts 60 generally function to scrape or ream the borehole sidewall 5 to maintain the borehole at full gage and prevent erosion and abrasion of heel surface 44. Steel teeth 81 of inner row 81 a as well as the lower portion of teeth 80 of row 80*a*, are employed primarily to gouge and remove formation material from the borehole bottom 7. Gage inserts 70 and the upper portion of first inner row teeth 80 cooperate to cut the corner 6 of the borehole. Steel teeth 80, 81 include layers of wear resistant "hardfacing" material 94 to improve durability of the teeth. Rows 80*a*, 81*a* are arranged and spaced on cutter 14 so as not to interfere with the rows of cutters on each of the other cone cutters 15, 16.

As shown in FIGS. 3–6, gage cutter elements 70 are preferably positioned along transition surface 45. This mounting position enhances bit 10's ability to divide corner cutter duty among inserts 70 and teeth 80 as described more fully below. This position also enhances the drilling fluid's ability to clean the inserts 70 and to wash the formation chips and cuttings past heel surface 44 towards the top of the borehole.

Figure 6:
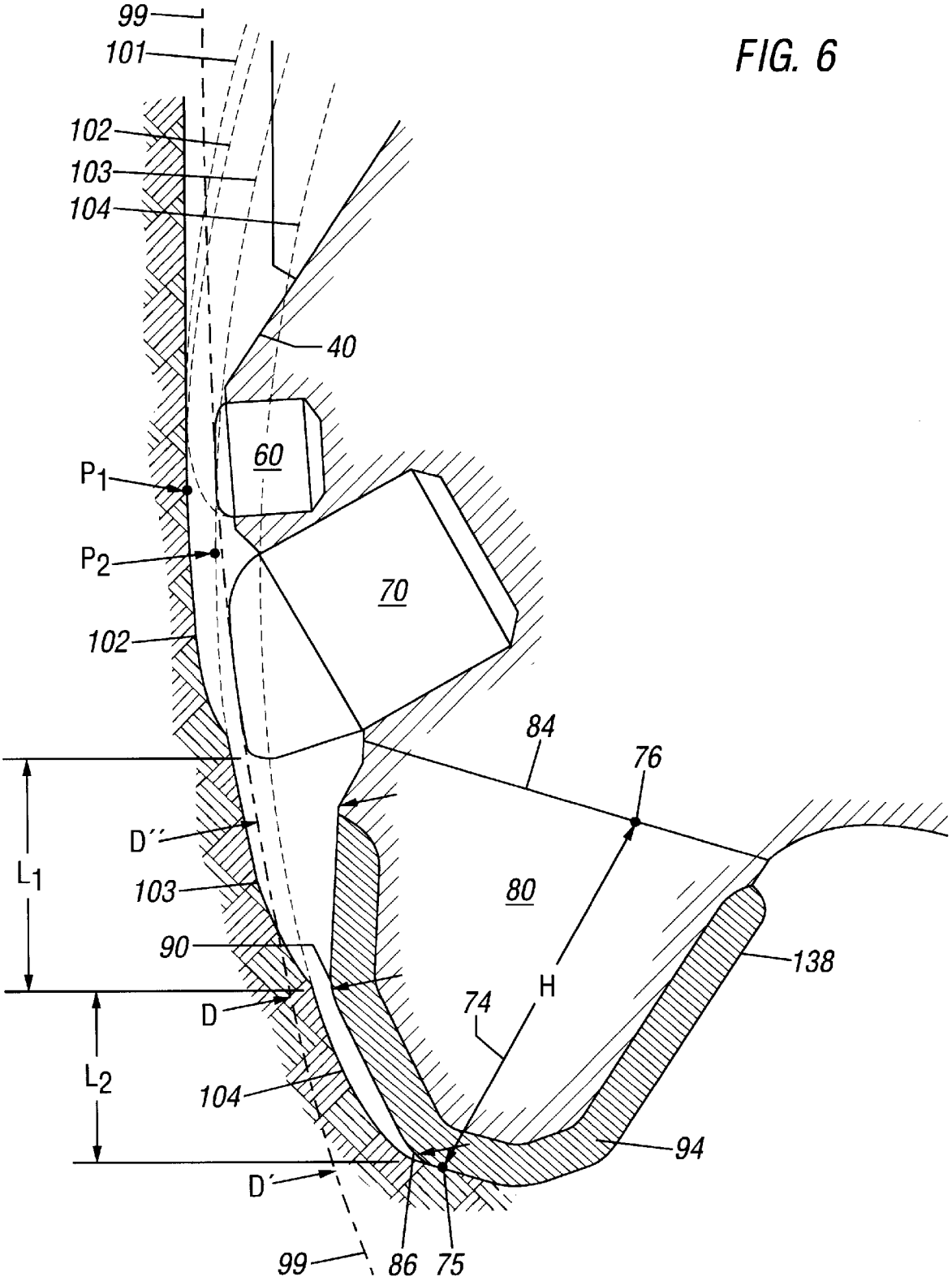
FIG. 6 is a enlarged view, partially in cross-section, of a portion of the cutting structure of the cone cutter shown in FIGS. 4 and 5 showing the cutting paths traced by certain of the cutter elements that are mounted on that cutter.

The spacing between heel inserts 60, gage inserts 70 and steel teeth 80–81, is best shown in FIGS. 4 and 6 which also depict the borehole formed by bit 10 as it progresses through the formation material. In FIGS. 4 and 6, the cutting profiles of cutter elements 60, 70, 80 are shown as viewed in rotated profile, that is with the cutting profiles of the cutter elements shown rotated into a single plane. Gage inserts 70 are positioned such that their cutting surfaces cut to full gage diameter, while the cutting tips 86 of first inner row teeth 80 are strategically positioned off-gage as described below in greater detail.

Figure 4A:
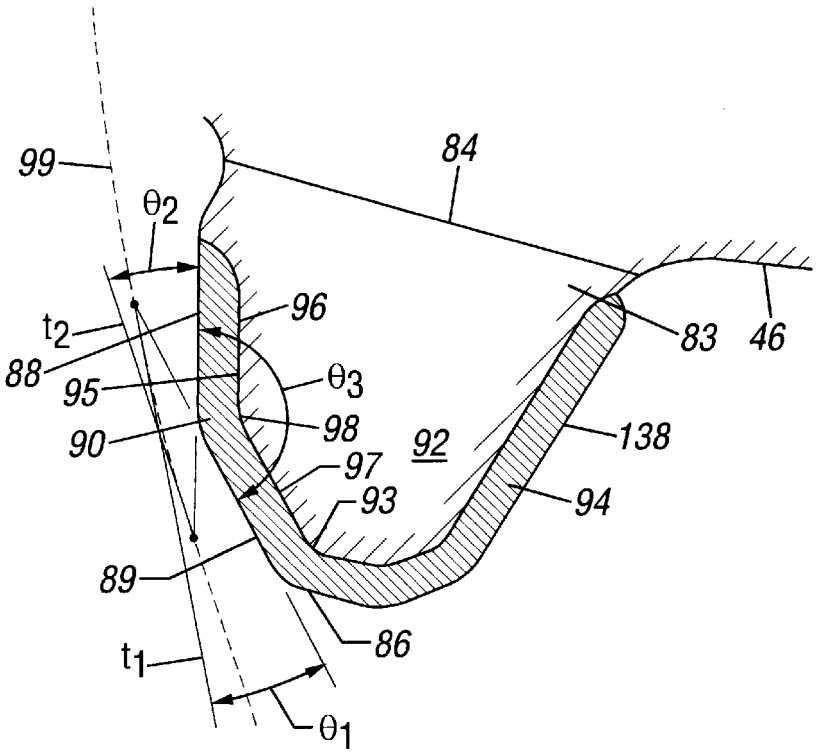
FIG. 4A is an enlarged view of a steel tooth cutter element of the cone cutter shown in FIG. 4
Figure 5:
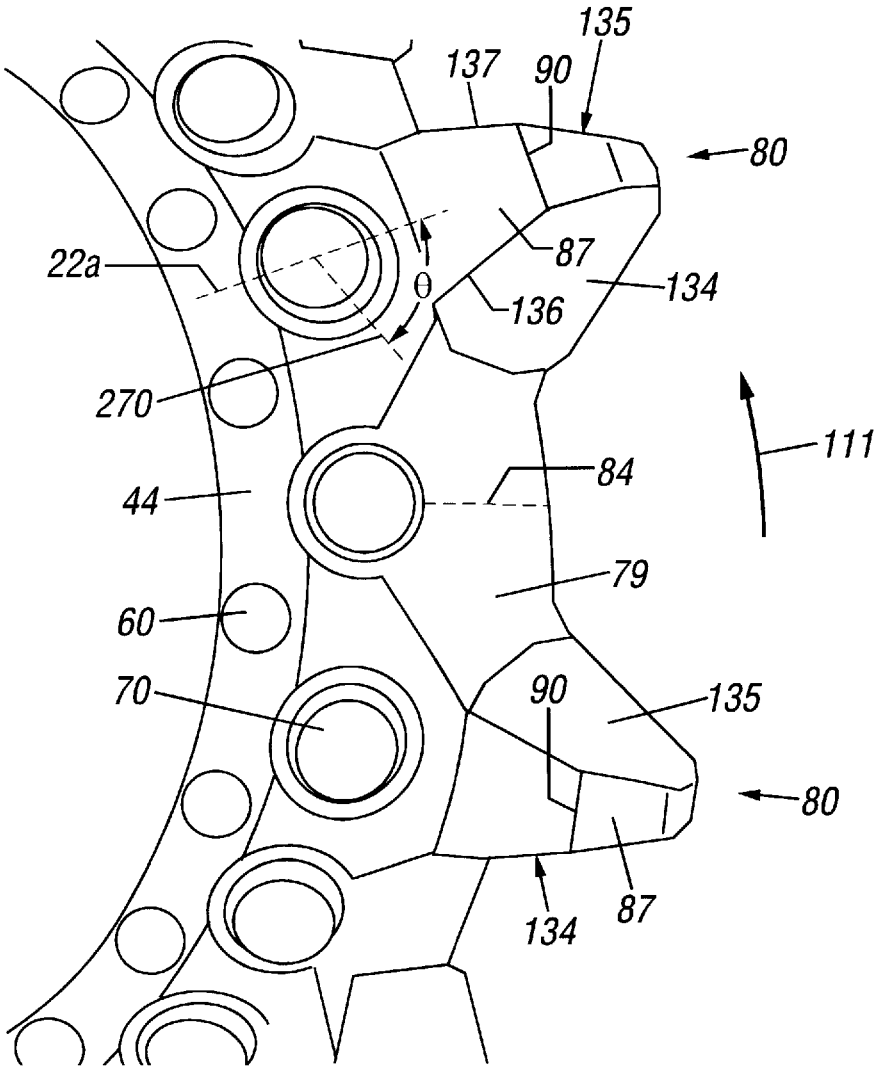
FIG. 5 is a perspective view of one cutter of the bit of FIG. 3.

Tooth 80 is best described with reference to FIGS. 4A, 5 and 6. Tooth 80 includes a root region 83 and a cutting tip 86. Root region 83 is the portion of the tooth 80 closest to root 79 which as described herein and shown in FIG. 5 is the portion of conical surface 46 on cone cutter 14 that extends between each pair of adjacent teeth 80. Referring momentarily to FIG. 5, an imaginary root line (represented by a dashed line 84 in FIG. 5) extends along the innermost portion of root 79 (relative to cone axis 22). Root line 84, also shown in FIGS. 4A and 6, may fairly be described as defining the intersection of tooth 80 and conical surface 46. Tip 86 is the portion of the tooth that is furthest from the root region 83 and that forms the radially outermost portion of tooth 80 as measured relative to cone axis 22. Tooth 80 includes an outer gage-facing surface 87 that generally faces the sidewall 5 of the borehole when cone cutter 14 is rotated to a position such that tooth 80 is in its closest position relative to the sidewall 5. Tooth 80 further includes an inwardly facing surface 138 generally facing teeth 81 (FIG. 4A) and two side surfaces 134, 135 that extend between surfaces 87 and 138 as best shown in FIG. 5.

Outer gage facing surface 87 includes upper portion 88, lower portion 89 and a knee 90. In the embodiment shown in FIGS. 4A and 6, upper and lower portions 88, 89 are generally planar surfaces that intersect to form knee 90. Although upper and lower portions 88, 89 may actually be slightly curved as a portion of what would be a frustoconical surface (such as where teeth 80 are machined from a parent metal "blank" in accordance with one typical manufacturing method), they may be fairly described as generally planar due to their relatively small degree of curvature. In this embodiment, knee 90 is thus a ridge formed between upper and lower portions 88, 89 and is the radially outermost portion of outer gage facing surface 87 as measured relative to the bit axis 11. The ridge forming knee 90 is shown in FIG. 5 as being generally straight; however, the invention is not so limited, and the ridge formed along outer gage facing surface 87 between sides 134, 135 may be nonlinear and may, for example, be arcuate.

Tooth 80 preferably includes a "parent metal" portion 92 formed from the same core metal as cone cutter 14, and an outer hard metal layer 94. Parent metal portion 92 extends from cone 14 to outer edge 93. Hard metal layer 94, generally known in the art as "hardfacing," is either integrally formed with the cone parent metal or is applied after the cone cutter 14 is otherwise formed. As shown, parent metal portion 92 includes an inner gage facing surface 95 that generally conforms to the configuration of outer gage facing surface 87 in the embodiments of FIGS. 4A, 5 and 6. More specifically, inner gage facing surface 95 includes upper portion 96, lower portion 97 and parent metal knee 98 formed there between. In this embodiment, parent metal knee 98 is the radially outermost portion of surface 95 measured relative to bit axis 11, and upper portion 96 and lower portion 97 incline from parent metal knee 98 toward bit axis 11.

Referring to FIG. 6, tooth 80 is configured and formed on cone cutter 14 such that knee 90 is positioned a first predetermined distance D from gage curve 99 and tip 86 is positioned a second predetermined distance D' from gage curve 99, D' being greater than D. As understood by those skilled in the art of designing bits, a "gage curve" is commonly employed as a design tool to ensure that a bit made in accordance to a particular design will cut the specified hole diameter. The gage curve is a complex mathematical formulation which, based upon the parameters of bit diameter, journal angle, and journal offset, takes all the points that will cut the specified hole size, as located in three dimensional space, and projects these points into a two dimensional plane which contains the journal centerline and is parallel to the bit axis. The use of the gage curve greatly simplifies the bit design process as it allows the gage cutting elements to be accurately located in two dimensional space which is easier to visualize. The gage curve, however, should not be confused with the cutting path of any individual cutting element as described more fully below.

A portion of the gage curve 99 of bit 10 and the cutting paths taken by heel row inserts 60, gage row inserts 70 and the first inner row teeth 80 are shown in FIG. 6. Referring to FIG. 6, each cutter element 60, 70, 80 will cut formation as cone 14 is rotated about its axis 22. As bit 10 descends further into the formation material, the cutting paths traced by cutters 60, 70, 80 may be depicted as a series of curves. In particular, heel row inserts 60 will cut along curve 101 and gage row inserts 70 will cut along curve 102. Knee 90 of steel teeth 80 of first inner row 80*a* will cut along curve 103 while tip 86 cuts along curve 104. As shown in FIG. 6, curve 102 traced by gage insert 70 extends further from the bit axis 11 (FIG. 2) than curve 103 traced by knee 90 of first inner tooth 80. The most radially distant point on curve 102 as measured from bit axis 11 is identified as $P_1$. Likewise, the most radially distant point on curve 103 is denoted by $P_2$. As curves 102, 103 show, as bit 10 progresses through the formation material to form the borehole, the knee 90 of first inner row teeth 80 does not extend radially as far into the formation as gage insert 70. Thus, instead of extending to full gage, knee 90 of each tooth 80 of first inner row 80*a* extends to a position that is "off-gage" by a predetermined distance D. As shown, knee 90 of tooth 80 is spaced radially inward from gage curve 99 by distance D, D being the shortest distance between gage curve 99 and knee 90, and also being equal to the difference in radial distance between outer most points $P_1$ and $P_2$ as measured from bit axis 11. Accordingly, knee 90 of first inner row of teeth 80 may be described as "off-gage," both with respect to the gage curve 99 and with respect to the cutting path 102 of gage cutter elements 70. This positioning of knee 90 allows knee 90 and gage insert 70 to share the corner cutting duty to a substantial degree. Similarly, tip 86 of tooth 80 extends to a position that is "off gage" by a predetermined distance D', where D' is greater than D. In this manner, cutting tip 86 is relieved from having to perform substantial sidewall cutting and can thus be optimized for bottom hole cutting.

As known to those skilled in the art, the American Petroleum Institute (API) sets standard tolerances for bit diameters, tolerances that vary depending on the size of the bit. The term "off gage" as used herein to describe portions of inner row teeth 80 refers to the difference in distance that cutter elements 70 and 80 radially extend into the formation (as described above) and not to whether or not teeth 80 extend far enough to meet an API definition for being on gage. That is, for a given size bit made in accordance with the present invention, portions of teeth 80 of a first inner row 80*a* may be "off gage" with respect to gage cutter elements 70 and gage curve 99, but may still extend far enough into the formation so as to fall within the API tolerances for being on gage for that given bit size. Nevertheless, teeth 80 would be "off gage" as that term is used herein because of their relationship to the cutting path taken by gage inserts 70 and their relationship to the gage curve 99. In more preferred embodiments of the invention, however, knee 90 and tip 86 of teeth 80 that are "off gage"(as herein defined), will also fall outside the API tolerances for the given bit diameter.

Figure 1:
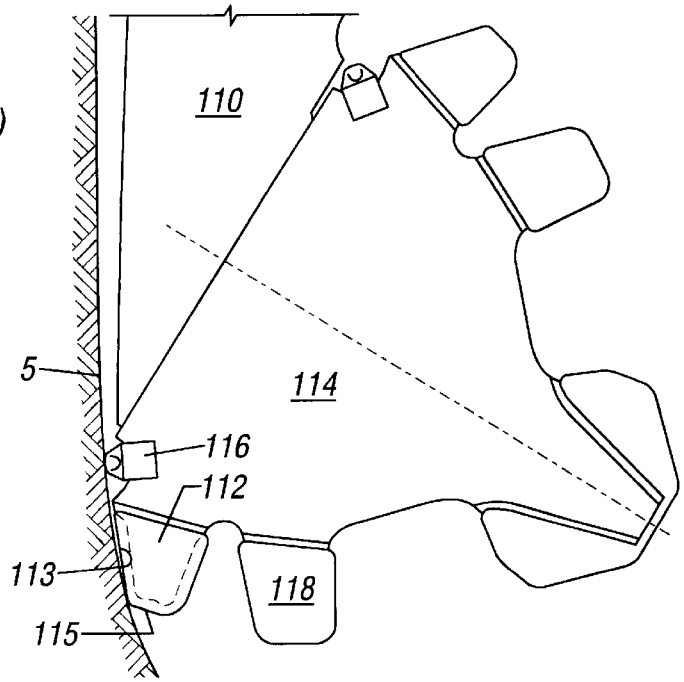
FIG. 1 (Prior Art)
FIG. 1 is a partial cross sectional profile view of one cone cutter of a prior art rolling cone steel tooth bit.

Referring again to FIG. 4A, it is preferred that lower portion 89 of outer gage facing surface 87 be inclined radially inward from knee 90 toward tip 86 at an angle $\theta_1$, that will be described herein as an "incline angle." As shown in FIG. 4A, incline angle $\theta_1$ is defined as the angle formed by the intersection of a plane containing lower portion 89 and a tangent $t_1$ to the gage curve 99 that is drawn at the point of intersection of the plane and the gage curve 99. Preferably, the incline angle $\theta_1$ is within the range of 7–40 degrees. Upper portion 88 also preferably tapers inwardly from knee 90 toward root region 83 such that the point on upper portion 88 furthest from knee 90 is a distance D" from the gage curve 99 (FIG. 6). It is desirable that upper portion 88 of gage facing surface 87 incline radially inwardly and away from knee 90 by an incline angle $\theta_2$ defined as the angle formed by the intersection of a plane containing upper portion 88 and a tangent $t_2$ to gage curve 99 as drawn at the point of intersection of the plane and gage curve 99 as shown in FIG. 4A. Preferably angle $\theta_2$ is between 8–25 degrees. Although the present invention also contemplates first inner row teeth 80 having an upper portion 88 of the gage facing surface 87 that is substantially parallel with respect to bit axis 11 (FIG. 9), or having upper portion 88 inclined radially outward from knee 90 (FIG. 10), the presently preferred structure is to incline upper portion 88 inwardly and away from knee 90 as shown in FIGS. 4A, 6. This arrangement optimizes the surface area of gage facing surface 87 that is in contact with the corner of the borehole. More particularly, an excessively large surface area in contact with the corner of the borehole will result in the following: (1) increased frictional heat generation, potentially leading to thermal fatigue of the gage facing surface and ultimately causing flaking of the hardmetal and/or tooth breakage; (2) increased in-thrust load to the bearing; and (3) inefficient cutting action against the borehole wall causing a decrease in ROP. Referring momentarily to FIG. 1, in an unworn (i.e., new and unused) conventional steel tooth bit, the surface area of gage facing surface 113 in contact with the borehole is relatively small and is concentrated adjacent to cutting tip 115 and thus is relatively efficient in its cutting action. However, because of the close proximity of the entire gage facing surface 113 to the gage curve 99, the surface area contacting the borehole wall increases rapidly as wear occurs, eventually leading to the problems described above. By contrast, and in accordance with the embodiment of the present invention shown in FIG. 6, inclining the upper portion 88 of the outer gage facing surface 87 inwardly and away from the knee 90 limits the rate of increase in surface area contact between gage facing surface 87 and the borehole wall as wear occurs. Tooth 80 is, in this way, better able to maintain its original configuration and cutting efficiency. By increasing or decreasing the incline angle $\theta_2$ of the upper portion 88 (thereby increasing or decreasing D"), the rate of increase of surface area in contact with the hole wall can be controlled to delay or avoid the undesirable consequences described above. A further benefit of providing incline angle $\theta_2$ is the additional relief area below the gage insert 70 when the insert is placed behind or in-line with the tooth 80. This additional relief area allows drilling fluid to more effectively wash across the insert 70, preventing formation material from packing between the insert and the tooth, thereby improving chip removal and enhancing/maintaining ROP. Without regard to the inclination of upper portion 88, the included angle $\theta_3$ formed by the intersection of the planes of upper and lower portions 88, 89 is less than 170 degrees and is preferably within the range of 135–160 degrees.

Referring again to FIGS. 4–6, it is shown that cutter elements 70 and knee 90 of tooth 80 cooperatively operate to cut the corner 6 of the borehole, while cutting tip 86 of tooth 80 and the other inner row teeth 81 attack the borehole bottom. Meanwhile, heel row inserts 60 scrape or ream the sidewalls of the borehole, but perform no corner cutting duty because of the relatively large distance that heel row inserts 60 are separated from gage row inserts 70. Cutter elements 70 and knee 90 of tooth 80 therefore are referred to as primary cutting structures in that they work in unison or concert to simultaneously cut the borehole corner, cutter elements 70 and knee 90 each engaging the formation material and performing their intended cutting function immediately upon the initiation of drilling by bit 10. Cutter elements 70 and knee 90 are thus to be distinguished from what are sometimes referred to as "secondary" cutting structures which engage formation material only after other cutter elements have become worn. Tips 86 of teeth 80 do not serve as primary gage cutting structures because of their substantial off gage distance D'.

Referring again to FIG. 1, a typical prior art bit 110 having rolling cone 114 is shown to have gage row teeth 112, heel row inserts 116 and inner row teeth 118. In contrast to the present invention, bit 110 employs a single row of cutter elements positioned on gage to cut the borehole corner (teeth 112). Gage row teeth 112 are required to cut the borehole corner without any significant assistance from any other cutter elements. This is because the first inner row teeth 118 are mounted a substantial distance from gage teeth 112 and thus are too far away to be able to assist in cutting the borehole corner. Likewise, heel inserts 116 are too distant from gage teeth 112 to assist in cutting the borehole corner. Accordingly, gage teeth 112 traditionally have had to cut both the borehole sidewall 5 along a generally gage facing cutting surface 113, as well as cut the borehole bottom 7 along the cutting surface shown generally at 115. Because gage teeth 112 have typically been required to perform both cutting functions, a compromise in the toughness, wear resistance, shape and other properties of gage teeth 112 has been required. Also, to ensure teeth 112 cut gage to the proper API tolerances, manufacturing process operations are required. More specifically, with prior art bits 110 having hardfacing applied to the gage row teeth 112 after the cone cutters are formed, it is often necessary to grind the gage facing surface 113 after the hardfacing is applied to ensure a portion of that surface fell tangent to the gage curve 99.

The failure mode of cutter elements usually manifests itself as either breakage, wear, or mechanical or thermal fatigue. Wear and thermal fatigue are typically results of abrasion as the elements act against the formation material. Breakage, including chipping of the cutter element, typically results from impact loads, although thermal and mechanical fatigue of the cutter element can also initiate breakage. Referring still to FIG. 1, chipping or other damage to bottom surfaces 115 of teeth 112 was not uncommon because of the compromise in toughness that had to be made in order for teeth 112 to withstand the sidewall cutting they were also required to perform. Likewise, prior art teeth 112 were sometimes subject to rapid wear along gage facing surface 113 and thermal fatigue due to the compromise in wear resistance that was made in order to allow the gage teeth 112 to simultaneously withstand the impact loading typically present in bottom hole cutting. Premature wear to surface 113 leads to an undergage borehole, while thermal fatigue can lead to damage to the tooth.

Referring again to FIG. 6, it has been determined that positioning the knee 90 of teeth 80 off gage, and positioning gage insert 70 on gage, substantial improvements may be achieved in ROP, bit durability, or both. To achieve these results, it is important that knee 90 of the first inner row 80*a* of teeth 80 be positioned close enough to gage cutter elements 70 such that the corner cutting duty is divided to a substantial degree between gage inserts 70 and the knee 90. The distance D that knee, 90 should be positioned off-gage so as to allow the advantages of this division to occur is dependent upon the bit offset, the cutter element placement and other factors, but may also be expressed in terms of bit diameter as follows:

TABLE 1

| Bit Diameter "BD" (inches) | Acceptable Range for Distance D (inches) | More Preferred Range for Distance D (inches) | Most Preferred Range for Distance D (inches) |
|---|---|---|---|
| BD ≦ 7 | .015–.150 | .020–.120 | .020–.090 |
| 7 < BD ≦ 10 | .020–.200 | .030–.160 | .040–.120 |
| 10 < BD ≦ 15 | .025–.250 | .040–.200 | .060–.150 |
| BD > 15 | .030–.300 | .050–.240 | .080–.180 |

If knee 90 of teeth 80 is positioned too far from gage, then gage row 70 inserts will be required to perform more bottom hole cutting than would be preferred, subjecting it to more impact loading than if it were protected by a closely-positioned but off-gage knee 90 of tooth 80. Similarly, if knee, 90 is positioned too close to the gage curve, then it would be subjected to loading similar to that experienced by gage inserts 70, and would experience more side hole cutting and thus more abrasion and wear than otherwise would be preferred. Accordingly, to achieve the appropriate division of cutting load, a division that will permit inserts 70 and teeth 80 to be optimized in terms of shape, orientation, extension and materials to best withstand particular loads and penetrate particular formations, the distance that knee, 90 of teeth 80 is positioned off-gage is important. Furthermore, to ensure that tip 86 of tooth 80 is substantially free from gage or sidewall cutting duty, it is preferred that distance D' be at least 1½ to 4 times, and most preferably two times, the distance D.

Referring again to FIG. 1, conventional steel tooth bits 110 that have relied on a single circumferential gage row of teeth 112 to cut the corner of the borehole typically have required that each cone cutter include a relatively large number of gage row teeth 112 in order to withstand the abrasion and sidewall forces imposed on the bit and thereby maintain gage. However, it is known that increased ROP in many formations is achieved by having relatively fewer teeth in a given bottom hole cutting row such that the force applied by the bit to the formation material is more concentrated than if the same force were to be divided among a larger number of cutter elements. Thus, the prior art bit 110 was again a compromise because of the requirement that a substantial number of gage teeth 112 be maintained on the bit in an effort to hold gage.

By contrast, and according to the present invention, because the sidewall and bottom hole cutting functions have been divided to a substantial degree between gage inserts 70 and knee 90 of teeth 80, a more aggressive cutting structure may be employed by having a comparatively fewer number of first inner row teeth 80 as compared to the number of gage row teeth 112 of the prior art bit 110 shown in FIG. 1. In other words, because in the present invention gage inserts 70 cut the sidewall of the borehole and are positioned and configured to maintain a full gage borehole, first inner row teeth 80, that do not have to function alone to cut sidewall or maintain gage, may be fewer in number and may be further spaced so as to better concentrate the forces applied to the formation. Concentrating such forces tends to increase ROP in certain formations. Also, providing fewer teeth 80 on the first inner row 80*a* increases the pitch between the cutter elements and the chordal penetration, chordal penetration being the maximum penetration of a tooth into the formation before adjacent teeth in the same row contact the hole bottom. Increasing the chordal penetration allows the teeth to penetrate deeper into the formation, thus again tending to improve ROP. Increasing the pitch between teeth 80 has the additional advantages that it provides greater space between the teeth 80 which results in improved cleaning around the teeth and enhances cutting removal from hole bottom by the drilling fluid.

To enhance the ability of knee 90 and gage insert 70 to cooperate in cutting the borehole corner as described above, it is important that knee 90 be positioned relatively close to insert 70. If knee 90 is positioned too far from root region 83, and thus is positioned a substantial distance from gage insert 70, knee 90 will be subjected to more bottom hole cutting duty. This increase in bottom hole cutting will result in tooth 80 wearing more quickly than is desirable, and will require gage inserts 70 to thereafter perform substantially more bottom hole cutting duty where it will be subjected to more severe impact loading for which it is not particularly well suited to withstand. Accordingly, as shown in FIG. 6, it is desirable that the distance $L_1$ measured parallel to bit axis 11 between knee 90 and point 71 on the cutting surface of gage insert 70 be no more than ¾ of the effective height H of tooth 80. As shown in FIG. 6, point 71 is the point that is generally at the lowermost edge of the portion of the insert's cutting surface that contacts the gage curve 99. As also shown, effective height H is measured along a line 74 that is parallel to backface 40 (and thus perpendicular to cone axis 22) and that passes through the most radially distant point 75 on tooth 80 (measured relative to cone axis 22). Effective height H of tooth 80 is the distance between point 75 and the point of intersection 76 of line 74 and root line 84. Similarly, distance $L_2$ measured parallel to bit axis 11 between cutting tip 86 and knee 90 should preferably be at least ¼ of H, and preferably not more than ¾H. The location of knee 90 is selected such that, typically, the surface area of upper portion 88 of gage facing surface will be greater than the surface area of lower portion 89.

In addition to performance enhancements provided by the present invention, the novel configuration and positioning of off gage teeth 80 further provides significant manufacturing advantages and cost savings. More specifically, given that the gage facing surface 87 of each tooth 80 is strategically positioned off gage, and that knee 90 remains off gage even after hardfacing 94 is applied, it is unnecessary to "gage grind" the gage facing surface 87 of off gage row teeth 80 as has often been required for conventional prior art steel tooth bits. That is, with many conventional steel tooth bits, after the hardfacing has been applied, the gage facing surfaces had to be ground in an additional manufacturing process to ensure that the gage surface was within API gage tolerances for the given size bit. This added a costly step to the manufacturing process. Gage grinding, as this process is generally known, tends to create regions of high stress at the intersections between the ground and unground surfaces. In turn, these high stress areas are more likely to chip or crack than unground materials.

Certain presently preferred hardfacing configurations and material selections for teeth 80 of the present invention will now be described with reference to FIGS. 7, 7A and 8A–8E. There are three primary characteristics that must be considered when selecting hardfacing materials for use on steel teeth in roller cone bits: chipping resistance; high stress abrasive wear resistance; and low stress abrasive wear resistance. Chipping resistance refers to the flaking and spalling of hardfacing on a macro scale. Differences between high stress and low stress abrasive wear lie in the differences in wear mechanisms. In a high stress abrasive wear situation, micro chipping and fracturing is more prevalent than in a low stress abrasive situation. In other words, the abrasive wear mechanism at a high stress condition is attributed to micro fracturing of hard phase particles and wear of the ductile matrix in the hardfacing overlay. By contrast, the wear mechanism in a low stress abrasive wear situation, is mostly attributed to preferential wear of the metal binder that lies between the hard phase particles in the microstructure. Typically, abrasive wear resistance is measured by standards established by the American Society of Testing & Materials (ASTM), low stress abrasive wear resistance being measured by standard ASTM-G65 and high stress abrasive wear resistance measured by standard ASTM-B611.

A specific hardfacing material composition can be designed such that all three wear characteristics are well balanced. Alternatively, one or two characteristics may be enhanced for a particular formation or duty, but this will be at the expense of the others. For example, a material having a lower volume fraction of hard phase particles (carbide) or having relatively tough hard phase particles (such as sintered spherical WC-Co pellets) will increase chipping resistance, with potential benefit also to the high stress abrasive wear resistance of the material. Selection of a material having more wear resistant, less tough hard phase particles (such as macro-crystalline tungsten carbide WC) and finer particle sizes (which leads to smaller mean free path between hard particles) will improve low stress abrasive wear resistance, but such a material will be more prone to chipping under high stress conditions.

For applications where very high and complex stress conditions exist, such as at the cutting tip of a tooth, chipping resistance and high stress abrasive wear resistance are mandated. For applications where cutting actions are mostly scraping and reaming (such as on the gage facing surface and in the root region of a tooth), low stress abrasive wear resistance should be given higher priority.

As used herein, hardfacing material referred to as "Type A" material has the characteristics of being chipping resistant and having a superior high stress abrasive wear resistance. Hardfacing material having superior low stress abrasive wear resistance shall be referred to herein as "Type B" material. Specific examples of Type A and Type B materials as may be employed in the present invention are known to those skilled in the art and may be selected according to the following criteria: Type A should have a high stress abrasive wear number not less than 2.5 (1000 rev/cc) per ASTM-B611; Type B should have a low stress abrasive wear volume loss of not greater than $1.5\times10^{-3}$ cc/1000 rev. per ASTM-G65. It will be understood that, over time, material science will advance such that the high stress abrasive wear number of Type A materials and the low stress abrasive wear volume loss of Type B materials will improve. However, by design, a Type A material will invariably exhibit a superior high stress abrasive wear resistance than that of a Type B material, and a Type B material will always exhibit a superior low stress abrasive wear resistance as compared to a Type A material. It is this fundamental difference in relative wear resistance that forms the basis for the use of two different hardfacing materials in the present invention.

Figure 7:
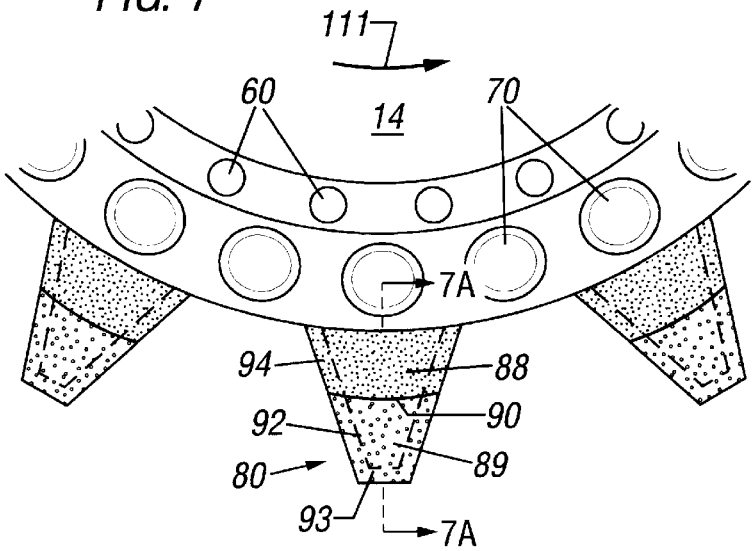
FIG. 7 is a partial elevation view of a rolling cone cutter showing an alternative embodiment of the invention employing differing hardfacing materials applied to the gage facing surface of a steel tooth.
Figure 7A:
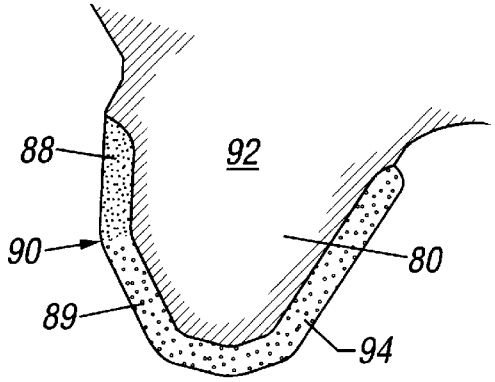
FIG. 7A is a partial sectional view of the cone cutter shown in FIG. 7.

In the embodiment of FIG. 7 and 7A having knee 90, upper portion 88 of gage facing surface 87 is formed with a Type B hardfacing material which has excellent low stress abrasive wear resistance, while lower portion 89 is covered with a Type A hardfacing material, which has superior high stress abrasive wear resistance. Thus, upper portion 88 is particularly suited for the scraping or reaming needed for sidewall cutting, while the lower portion 89 of the tooth 80 is well suited for bottom hole cutting where the tooth experiences more impact loading. Parent metal portion 92 of tooth 80 is shown in phantom in FIG. 7. As shown in FIGS. 7 and 7A, in this embodiment, the hardfacing materials 94 form the entire gage facing surface 87.

Figure 8A:
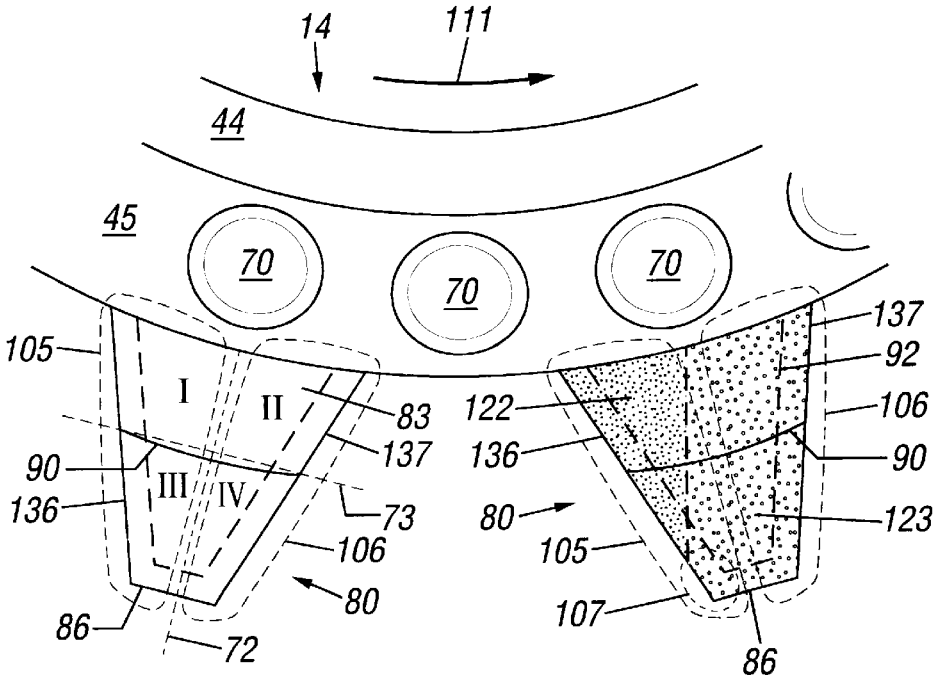
FIG. 8A–8E are partial elevation views similar to FIG. 7 showing alternative embodiments of the invention.

Similarly, as shown in FIG. 8A, different hardfacing materials may be applied to the leading and trailing portions of outer gage facing surface 87 to enhance durability of tooth 80. More specifically, and referring momentarily to FIG. 5, as cone 14 rotates in the borehole in the direction of arrow 111, a first or "leading" edge 136 of tooth 80 will approach the hole wall before the opposite trailing edge 137. Leading edge 136 is formed at the intersection of outer gage facing surface 87 and side 134. Trailing edge 137 is formed at the intersection of surface 87 and side 135. Referring again to FIG. 8A, in a similar manner, one portion of gage facing surface 87 of tooth 80 will contact the hole wall first. This portion is referred to herein as the leading portion and is generally denoted in FIG. 8A by reference numeral 105. Trailing portion 106 is the last portion of outer gage facing surface 87 to contact the hole wall.

For purposes of the following explanation, it should be understood that the gage facing surface 87 of tooth 80 may be considered as being divided by imaginary lines 72, 73 into four quadrants shown in FIG. 8A as quadrants I–IV. Quadrants I and II are generally adjacent to root region 83 with quadrant I also being adjacent to leading edge 136 and quadrant II being adjacent to trailing edge 137. Quadrants III and IV are adjacent to cutting tip 86 with quadrant III being also adjacent to leading edge 136 and quadrant IV being adjacent to trailing edge 137. In embodiments of the invention having knee 90, the dividing line 73 between the quadrants closest to cutting tip 86 (III and IV) and the quadrants closest to root region 83 (I and II) is drawn substantially through knee 90. In a tooth 80 formed without a knee 90, line 73 is to be considered as passing through a point generally ½ the effective tooth height H from tip 86. Line 72 generally bisects gage facing surface 87.

Although leading and trailing portions 105, 106 cooperate to cut the formation material, each undergoes different loading and stresses as a result of their positioning and the timing in which they act against the formation. Accordingly, it is desirable in certain formations and in certain bits to optimize the hardfacing that comprises outer gage facing surface 87 and to apply different hardfacing to the leading and trailing portions 105, 106 as illustrated in FIG. 8A. Also, as mentioned above, it is desirable for the lower portion 89 of outer gage facing surface 87 to be hardfaced with a more durable and impact resistant material as compared with the upper portion 88 of the outer gage facing surface. This presents a design compromise in the area near leading edge 136 adjacent cutting tip 86 generally identified as region 107. Thus, as shown in FIG. 8A, a low stress abrasive wear resistant Type B material is applied to most of leading portion 105, while a more chipping resistant and high stress abrasive wear resistant Type A material is applied to the trailing portion 106, region 107 and along the outer gage facing surface 87 adjacent cutting tip 86. These differing hardfacing materials are thus applied to parent metal portion 92 in an asymmetric arrangement of the regions shown generally as leading region 122 and asymmetric, strip-like trailing region 123. Leading region 122 is generally triangular and has a Type B material applied to it as compared to the trailing region 123. As shown, leading region 122 generally includes the leading portion 105 of upper portion 88 but terminates short of region 107. The more chipping and high stress abrasive wear resistant hardfacing material of Type A is applied to asymmetric trailing region 123 which extends from root region 83 to tip 86 and includes all of trailing portion 106 and region 107 to protect tip 86. Regions 122 and 123 are generally contiguous polygonal regions that together form gage facing surface 87. As used herein, the terms "polygon" and "polygonal" shall mean and refer to any closed plane figure bounded by generally straight lines, the terms including within their definition closed plane figures having three or more sides.

Figure 8B:
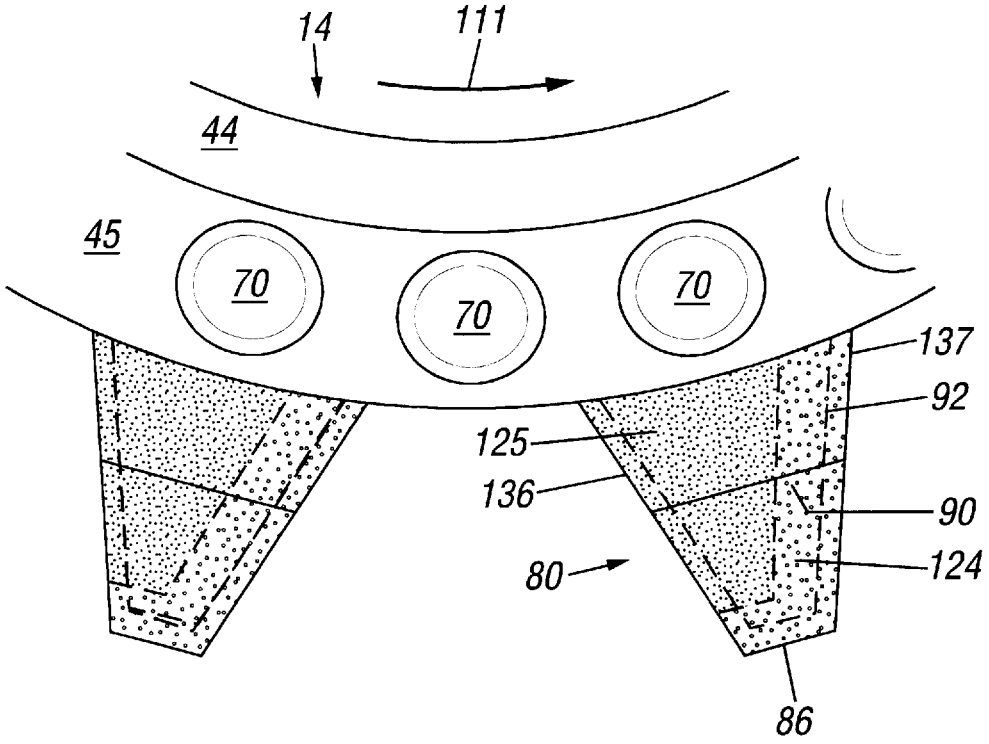

A similar configuration of Type A and Type B hardfacing forming gage facing surface 87 is shown in FIG. 8B. As in the embodiment described with reference to FIG. 8A, a Type B material is applied to most of leading portion 105, with region 107 adjacent to tip 86 being covered with a Type A material. The entire trailing portion 106 is also covered with a Type A material. As shown, outer gage facing surface 87 in this embodiment thus includes an L-shaped polygonal region 124 of Type A material covering the trailing portion 106, cutting tip 86 and region 107. The remainder of gage facing surface 87 is hardfaced in region 125 with a Type B material. The embodiments of FIGS. 8A and 8B are designed to achieve the same objectives and are substantially identical, except that the leading region 122 is generally triangular in the embodiment of FIG. 8A, while leading region 125 is generally formed as a quadrangle in the embodiment of FIG. 8B.

Figure 8C:
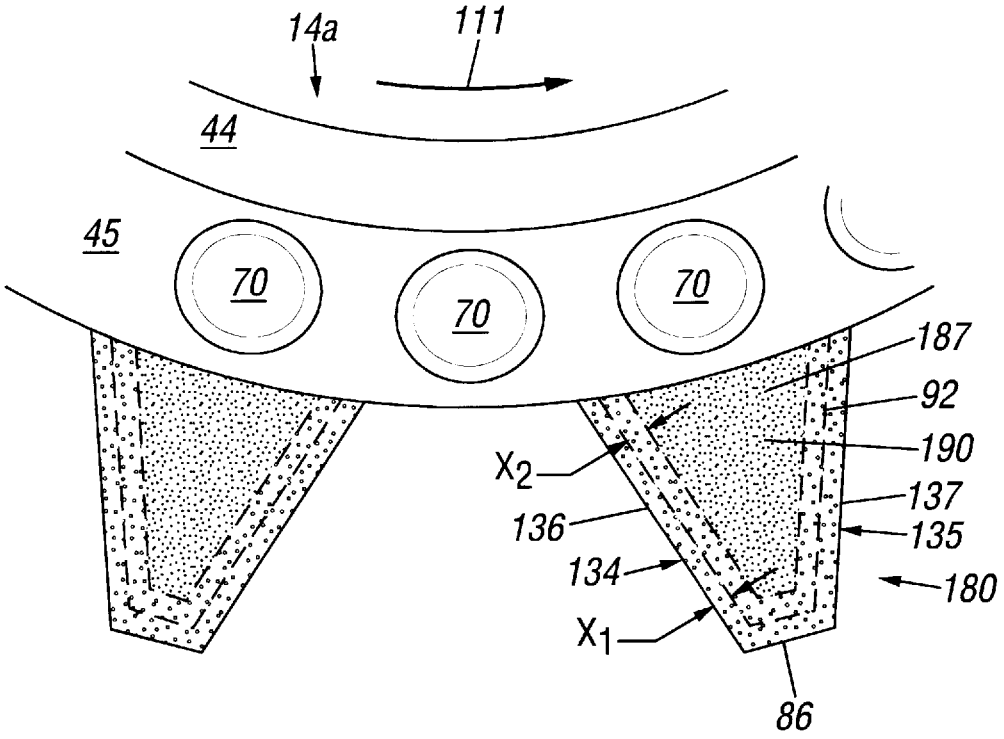

Although this application of differing hardfacing materials to form leading and trailing regions of outer gage facing surface 87 is preferably employed on a tooth 80 having knee 90 as shown in FIG. 8A and 8B, the invention is not so limited and may alternatively be employed in conventional steel teeth that do not include any knee 90. For example, referring to FIG. 8C, a steel tooth rolling cone cutter 14*a* is shown having steel teeth 180 that include an outer gage facing surface 187 formed without a knee 90 between root region 83 and cutting tip 86. Outer gage facing surface 187 is generally planar and is covered with two hardfacing materials. In this embodiment, Type A material is applied adjacent to and along leading and trailing edges 136, 137 and cutting tip 86. The remainder of outer gage facing surface 187, shown as a generally trapezoidal central region 190, is coated with Type B hardfacing material. Such an embodiment having high stress abrasive wear resistant material along leading edge 136 and in leading portion 105 is believed advantageous in relatively high strength rock formations where experience has shown that brittle fracture of the hardfacing material often occurs in prior art bits due primarily to stress risers at the sharp edges of the tooth and at the intersection of different hardfacing materials. This embodiment may also be desirable where a Type A hardfacing is employed on sides 134 and 135 of tooth 80. In that event, the Type A material applied to sides 134 and 135 may be continued or "wrapped" around edges 136 and 137 to form a portion of gage facing surface 87. In this embodiment, with hardfacing applied to the parent metal on sides 134 and 135 to a thickness $X_1$, it is preferred that the hardfacing be wrapped a distance $X_2$, that is greater than or equal to $X_1$, as shown in FIG. 8C. Preferably, dimension $X_1$ is within the range of 0.040–0.120 inch, and most preferably within the range of 0.060–0.090 inch.

Figure 8D:
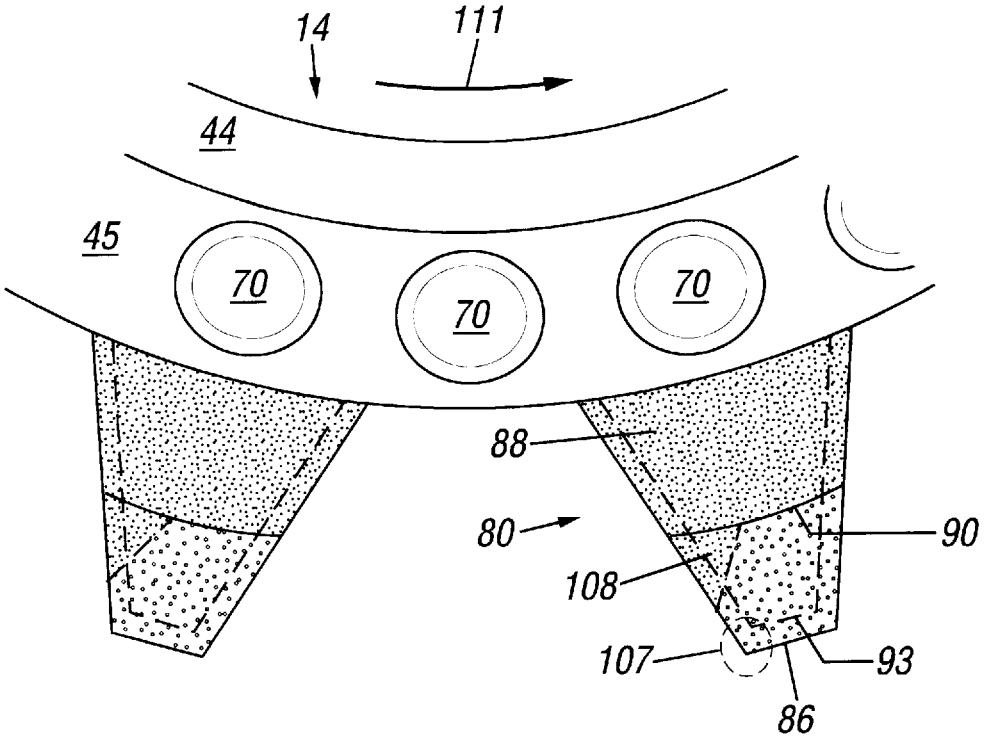

FIG. 8D shows another preferred hardfacing configuration of the present invention. Tooth 80 includes knee 90 as previously described. The entire upper portion 88 is covered with a Type B material. The lower portion 89 adjacent to leading edge 136 is also covered along its length with Type B material with the exception of region 107. Like the embodiment described with reference to FIG. 8A, region 107 is covered with a Type A material that has a high resistance to chipping and exhibits superior high stress abrasive wear resistance. In this configuration, all of lower portion 89 of outer gage facing surface 87 is covered with a Type A material, with the exception of generally triangular region 108.

Figure 8E:
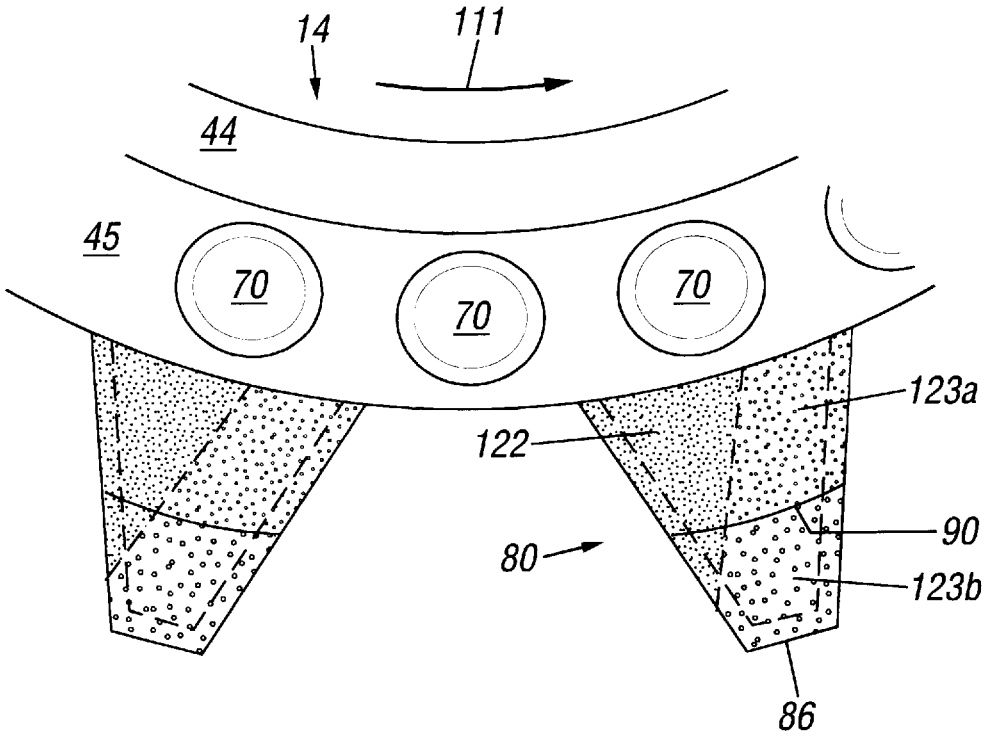

Three different hardfacing materials may also be optimally applied to outer gage facing surface 87 as shown in FIG. 8E. Given the substantially different cutting duty seen by upper and lower portions 88, 89, and the different duty experienced by leading and trailing portions 105, 106 (FIG. 8A), regions of each of upper and lower portions 88, 89 of gage facing surface 87 have hardfacing materials with differing characteristics. As shown in FIG. 8E, the strip-like trailing region 123 (previously shown in FIG. 8A) is generally divided at knee 90 into upper trailing region 123*a* and lower trailing region 123*b*. Lower trailing region 123*b* is hardfaced with a Type A material that is more resistant to chipping and to high stress abrasive wear than the material applied to upper trailing region 123*a*. The generally triangular leading region 122 is hardfaced with a Type B material that has better or equivalent low stress abrasive wear resistance than that used in regions 123*a* or 123*b*. Accordingly, outer gage facing surface 87 of tooth 80 in the embodiment of FIG. 8E has three generally distinct regions that are optimized in terms of hardness, abrasive wear resistance and toughness as determined by the cutting duty generally experienced by that particular region.

Additional alternative embodiments of tooth 80 are shown in FIGS. 9–12, 13A–13F. Although it is most desirable that knee 90 be off gage a distance D (FIG. 6), many of the advantages of the present invention can be achieved where knee 90 extends to the gage curve 99 as shown in FIG. 11. In that embodiment of the invention, knee 90 and gage insert 70 still cooperate to cut the borehole corner, and cutting tip 86 is positioned a distance D' off the gage curve where, in this embodiment, D' is preferably equal to the distance D identified in Table 1. This arrangement will again relieve tip 86 from substantial side wall cutting duty and thereby prevent or slow the abrasive wear to the outer gage facing surface 87 adjacent to tip 86. In the embodiment of FIG. 11 , however, some gage grinding could be required to maintain API tolerances for bit diameter.

In the previously described embodiments, tip 86 is positioned off the gage curve 99 by inwardly inclining the generally planar lower portion 89 of gage facing surface 87. Lower portion 89 may, however, be nonplanar. For example, as shown in FIG. 12A, lower portion 97 of inner gage facing surface 95 may be made concave. Where hardfacing is applied to concave lower portion 97 in a manner such that hardfacing 94 has a substantially uniform thickness, tip 86 may be positioned off gage to the desired distance D' while the concavity provides sharper knee 90 as may be desirable in certain soft formations. To increase the durability of lower portion 89 of outer gage facing surface 87, as may be required in more abrasive formations, for example, the concavity of curved lower portion 97 of the inner gage facing surface 95 may be filled with hardfacing material as illustrated in FIG. 9. This provides an increased thickness of hardfacing as compared to the hardfacing thickness along surface 88 of embodiments of tooth 80 shown in FIGS. 6 and 12A. Another embodiment having a concave lower portion 89 of outer gage facing surface 87 is shown in FIG. 12B. As shown therein, knee 90 and upper portion 88 are on gage, upper portion 88 configured so as to hug the gage curve 99. In this embodiment, upper portion 88 cuts the borehole corner without assistance from a gage insert 70. Cutting tip 86 is positioned off gage as previously described.

Figure 13B:
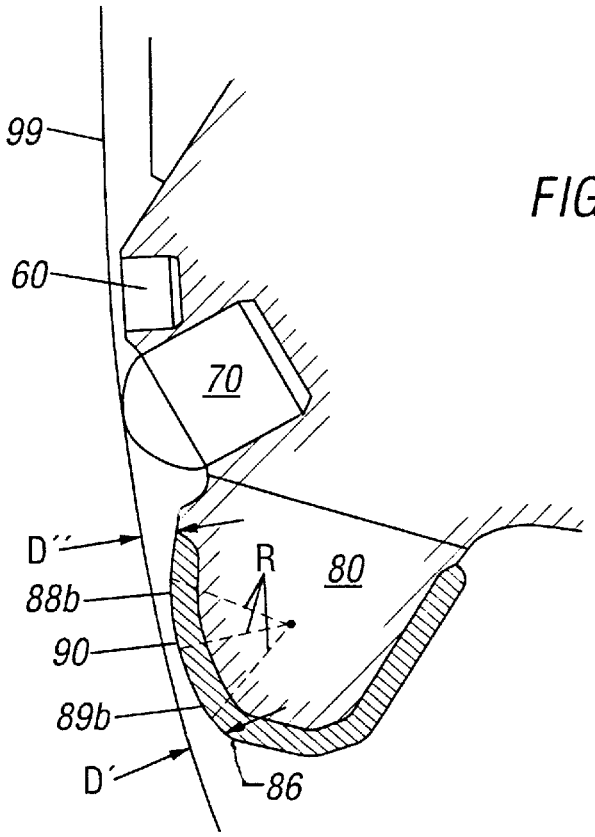

Although in the preferred embodiment of tooth 80 thus far described, knee 90 is formed as a substantially linear intersection of generally planar surfaces 88, 89, it should be understood that the term "knee" as used herein is not limited to only such a structure. Instead, the term knee is intended to apply to the point on the outer gage facing surface 87 of tooth 80 below which every point is further from the gage curve 99 when the tooth 80 is at its closest approach to the gage curve. Thus, knee 90 on outer gage facing surface 87 may be formed by the intersection of curved upper and lower surfaces 88*a*, 89*a*, respectively, which form outer gage facing surface 87 where surfaces 88*a* and 89*a* have different radii of curvature as shown in FIG. 13A. As shown, lower portion 89 includes a curved surface having a radius R1 while upper portion 88*a* has a curved surface with radius R2, where R2 is preferably greater than R1. Similarly, a knee 90 may be formed by upper and lower curved surfaces that have equal radii but different centers. Also, as shown in FIG. 13B, outer gage facing surface 87 may be a continuous curved surface of constant radius R. In this embodiment, upper curved surface 88*b* and lower curved surface 89*b* have the same radius R and the same center. Knee 90 is the point that is a distance D from gage curve 99 and is the closest point on outer gage facing surface 87 below which every point is further from the gage curve 99. Tip 86 is a distance D' off gage, and the uppermost portion of upper curved surface 88*b* is a distance D" off gage as previously described.

Although in various of the Figures thus far described hardfacing layer 94 has been generally depicted as being of substantially uniform thickness, the present invention does not so require. In actual manufacturing, the thickness of hardfacing may not be uniform along outer gage facing surface 87. Likewise, and referring to FIG. 4A, for example, the invention does not require that upper portion 88 of outer gage facing surface 87 or upper portion 96 of inner gage facing surface 95 be substantially parallel (or that lower surfaces 89 and 97 be parallel). Thus, even where surfaces 96 and 97 of parent metal portion 92 are each planar and intersect in a well defined ridge at inner knee 98, the completed tooth 80 may have a less defined knee 90. In fact, gage facing surface 87 may appear generally rounded such as shown in FIG. 13B, rather than formed by the intersection of two planes as generally depicted in FIG. 4A. However, without regard to the uniformity of hardfacing thickness applied to inner gage facing surface 95 of parent metal portion 92, in the present invention a knee will be formed on outer gage facing surface 87 at a predetermined point that is closest to the gage curve 99 and below which all points are further from the gage curve 99.

Although, it is usually desirable that upper portion 88 of outer gage facing surface 87 incline radially inward and away from knee 90 by an angle $\theta_2$ as previously described, the present invention also contemplates a tooth 80 where upper portion 88 of outer gage facing surface 87 is substantially parallel to bit axis 11 as well as where the upper portion 88 inclines outwardly at an angle $\theta_4$ from knee 90 toward the borehole side wall, $\theta_4$ being measured between the plane containing upper portion 88 and a line 125 parallel to bit axis 11 as shown in FIG. 10. In an embodiment such as FIG. 10 where upper portion 88 is inclined toward gage curve 99 at an angle $\theta_4$ such that D" is less than D, the knee 90 is defined by the point where there is a discontinuity of the surface 87 and below which all points are further from the gage curve.

Figure 13C:
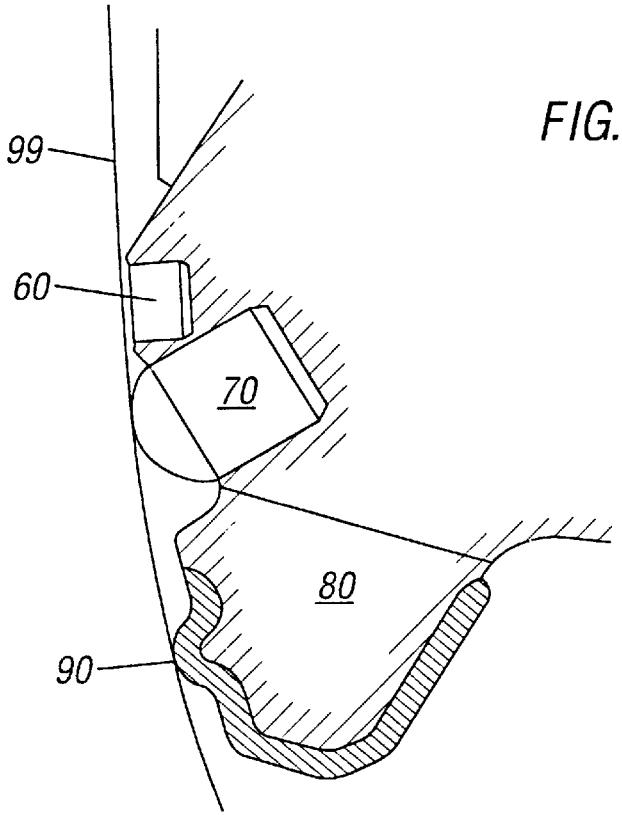
Figure 13D:
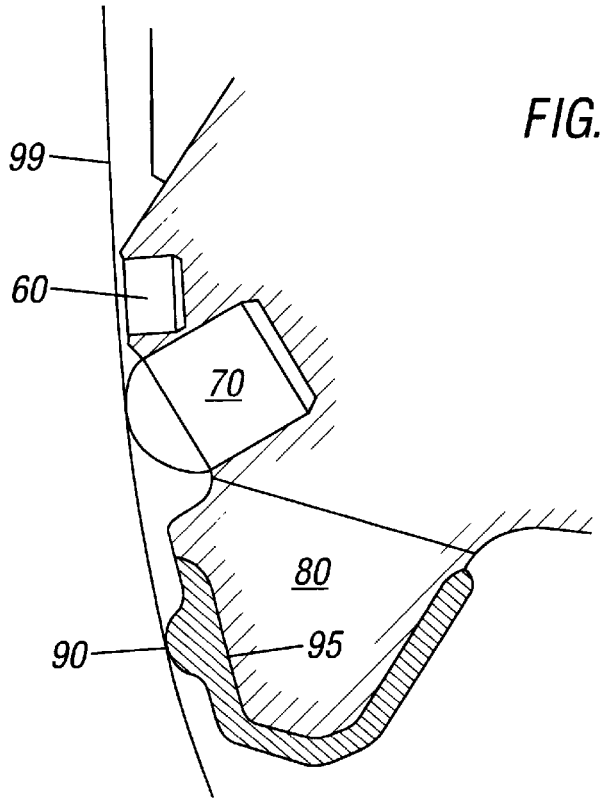
Figure 13E:
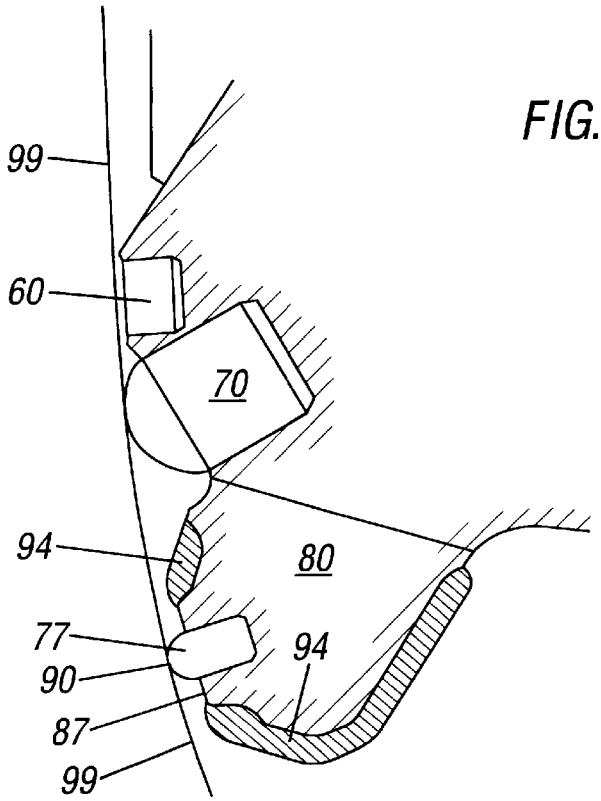

Referring now to FIGS. 13C and 13D, knee 90 may be formed as a projection or a raised portion of the parent metal portion 92 from which tooth 80 is machined or cast (shown with a hardfaced layer in FIG. 13C but could be formed without hardfacing), or may be a protrusion of hardfacing material extending from a substantially planar parent metal surface 95 as shown in FIG. 13D. Alternatively, knee 90 may be formed by the cutting surface of a hard metal insert 77 that is embedded into the gage facing surface 87. An example of such a knee 90 is shown in FIG. 13E where TCI insert 77 having a hemispherical cutting surface forms knee 90. Another example is shown in FIG. 13F where the cutting surface of insert 77 forms knee 90 and where insert 77 is preferably configured like insert 200 described in more detail below.

Further alternative embodiments of tooth 80 are shown in FIGS. 14A and 14B. Referring first to FIG. 14A, lower portion 89 of outer gage facing surface 87 may be configured to have shoulders 130 at each side 134, 135 of the gage facing surface (and optionally, as shown, on the generally inwardly-facing surface 138 of tooth 80 that is on the opposite side of tooth 80 from outer gage facing surface 87). Preferably, shoulders 130 are formed at a location adjacent to knee 90 or between knee 90 and root region 83. The edges of tooth 80 are radiused between shoulders 130 and tip 86 so as to create a step 132 on the sides 134, 135 of tooth 80. Step 132 has a generally constant curvature and width "W" throughout the width of tooth 80 as measured between outer gage facing surface 87 and inwardly facing surface 138. This creates a flared or stepped profile for outer gage facing surface 87 and permits the surface area of upper portion 88 to remain relatively large with respect to the surface area of lower portion 89 as is desirable for purposes of sidewall reaming and scraping. At the same time, the flared configuration provides a relatively sharp cutting tip 86 as is desirable for bottom hole cutting.

The embodiment of FIG. 14B is similar to that of FIG. 14A except inwardly-facing surface 138 of tooth 80 does not include shoulders 130 and thus does not have a flared or stepped profile as does outer gage facing surface 87. As such, the width of step 132 on the sides 134, 135 of tooth 80 taper or narrow from a width "W" closest to outer gage facing surface 87 to zero at inwardly-facing surface 138. This embodiment has the advantage of potentially allowing greater tooth penetration into the formation while simultaneously providing an increased surface area on upper portion 88 of gage facing surface 87 as is desirable to help resist or slow abrasive wear on surface 87. In the embodiment of either FIG. 14A or 14B, the step need not be continuous along the entire side 134, 135 of the tooth. Instead, the step may terminate at an intermediate point between gage facing surface 87 and inwardly facing surface 138. Likewise tooth 80 may have a shoulder 130 and step 132 on only the leading side 134 or the trailing side 135.

Referring again to FIG. 5, gage row inserts 70 can be circumferentially positioned on transition surface 45 at locations between each of the inner row teeth 80 or they can be mounted so as to be aligned with teeth 80. For greater gage protection, it is preferred to include gage inserts 70 aligned with each tooth 80 and between each pair of adjacent teeth 80 as shown in FIG. 5. This configuration further enhances the durability of bit 10 by providing a greater number of gage inserts 70 for cutting the borehole sidewall at the borehole corner 6.

Figure 15A:
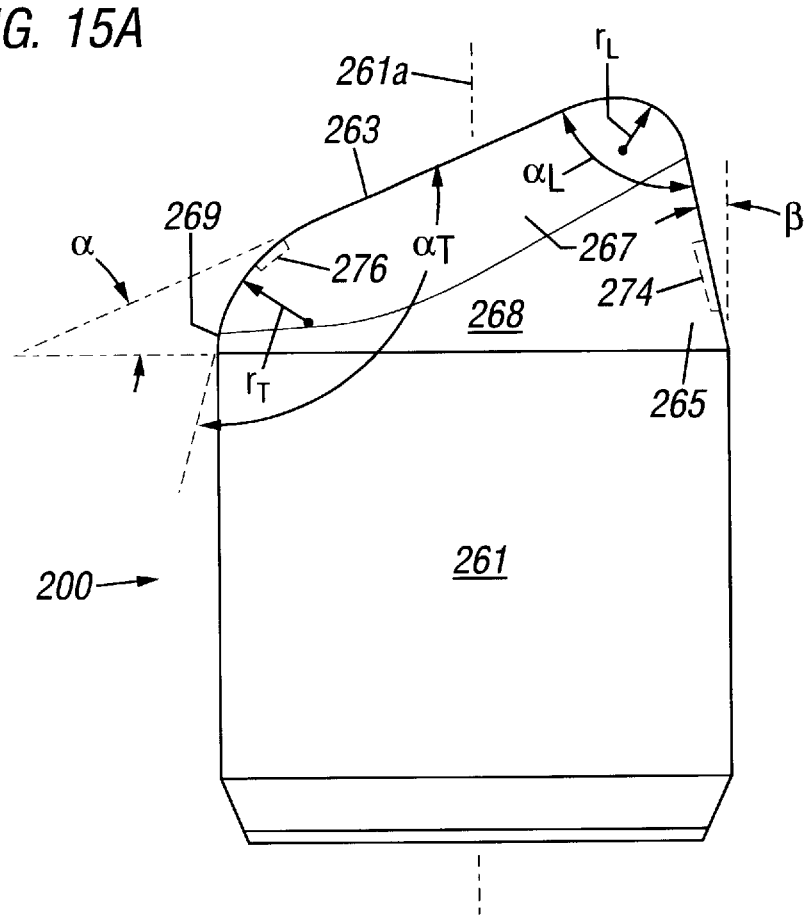
FIGS. 15A and 15B are elevation and top view, respectively, of one of the cutter elements shown in FIGS. 4–6.
Figure 15B:
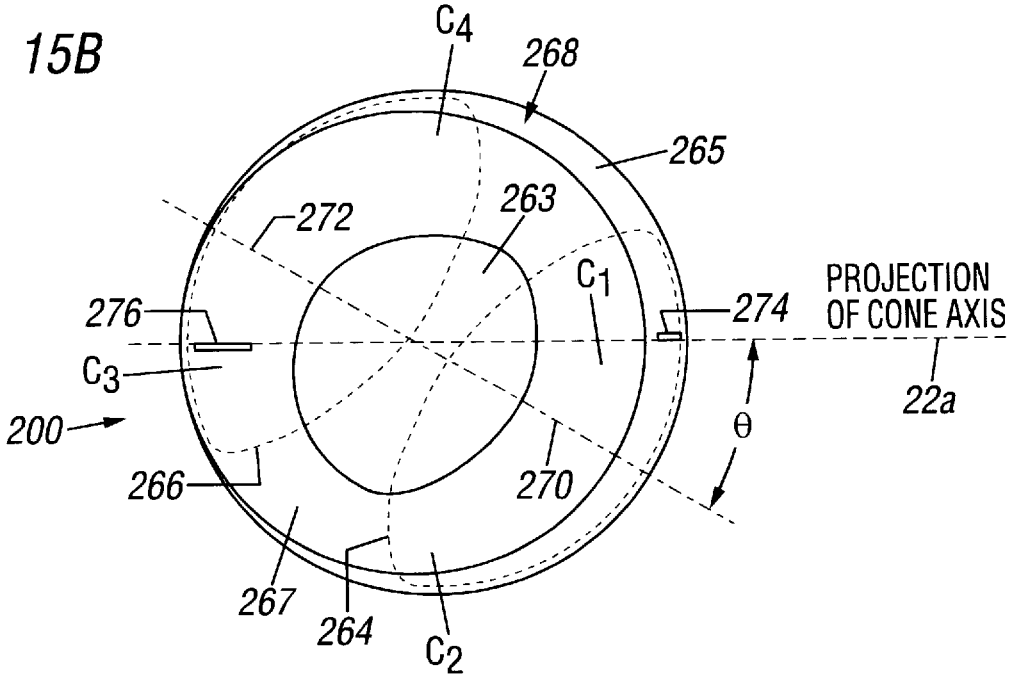

Although any of a variety of shaped inserts may be employed as gage cutter element 70, a particularly preferred insert 200 is shown in FIGS. 15A and 15B. Insert 200 is preferably used in the gage position indicated as 70 in FIG. 1, but can alternatively be used to advantage in other cutter positions as well.

Insert 200 includes a base 261 and a cutting surface 268. Base 261 is preferably cylindrical and includes a longitudinal axis 261*a*. Cutting surface 268 of insert 200 includes a slanted or inclined wear face 263, frustoconical leading face 265, frustoconical trailing face 269 and a circumferential transition surface 267. Wear face 263 can be slightly convex or concave, but is preferably substantially flat. As best shown in FIG. 15A, wear face 263 is inclined at an angle $\alpha$ with respect to a plane perpendicular to axis 261*a*, and frustoconical leading face 265 defines an angle $\beta$ with respect to axis 261*a*. As shown, $\beta$ measures only the angle between leading face 265 and axis 261*a*. The angle between axis 261*a* and other portions of cutting surface 268 may vary. It will be understood that the surfaces, including leading face 265 and trailing face 269, need not be frustoconical, but can be rounded or contoured . When inserted into cone 14 as gage cutter element 70, wear face 263 of insert 200 preferably hugs the borehole wall to provide a large area for engagement (FIGS. 4–6).

Circumferential transition surface 267 forms the transition from wear face 263 to leading face 265 on one side of insert 200 and from wear face 263 to trailing face 269 on the opposite side of insert 200. Circumferential shoulder 267 includes a leading compression zone 264 and a trailing tension zone 266 (FIG. 15B). It will be understood that, as above, the terms "leading compression zone" and "trailing tensile zone" do not refer to any particularly delineated section of the cutting face, but rather to those zones that undergo the larger stresses (compressive and tensile, respectively) associated with the direction of cutting movement. The position of compression and tension zones 264, 266 relative to the axis of rolling cone 14, and the degree of their circumferential extension around insert 200 can be varied without departing from the scope of this present invention.

Referring to FIGS. 5 and 15B, in a typical preferred configuration, a radial line 270 through the center of leading compression zone 264 lies approximately 10 to 45 degrees, and most preferably approximately 30 degrees, clockwise from the projection 22*a* of the cone axis, as indicated by the angle $\theta$ in FIG. 15B. A line 272 through the center of trailing tension zone 266 preferably, but not necessarily, lies diametrically opposite leading center 270.

In accordance with the present invention, leading compression zone 264 is sharper than trailing tension zone 266. Because leading compression and trailing tension zones 264 and 266 are rounded, their relative sharpness is manifest in the relative magnitudes of $r_L$ and $r_T$ (FIG. 15A), which are radii of curvature of the leading compression and trailing tension zones, respectively, and $\alpha_L$ and $\alpha_T$,, which measure the inside angle between wear face 263 and the leading and trailing faces 265, 269. Circumferential transition surface 267 is preferably contoured or sculpted, so that the progression from the smallest radius of curvature to the largest is smooth and continuous around the insert. For a typical 5/16" diameter insert constructed according to a preferred embodiment, the radius of curvature of surface 267 at a plurality of points $c_{1-4}$ (FIG. 15B) is given in the following Table I.

TABLE 1

| Point | Radius of Curvature (in.) |
|---|---|
| $c_1$ | .050 |
| $c_2$ | .050 |
| $c_3$ | .120 |
| $c_4$ | .080 |

By way of further example, for a typical 7/16" diameter insert constructed according to the present invention, the radii at points $c_{1-4}$ are given in the following Table II.

TABLE II

| Point | Radius of Curvature (in.) |
|---|---|
| $c_1$ | .050 |
| $c_2$ | .050 |
| $c_3$ | .160 |
| $c_4$ | .130 |

An optimal embodiment of the present invention requires balancing competing factors that tend to influence the shape of the insert in opposite ways. Specifically, it is desirable to construct a robust and durable insert having a large wear face 263, an aggressive but feasible leading compression zone 264, and a large $r_T$ so as to mitigate tensile stresses in trailing tension zone 266. Changing one of these variables tends to affect the others. One skilled in the art will understand that the following quantitative amounts are given by way of illustration only and are not intended to serve as limits on the individual variables so illustrated.

Thus, by way of illustration, in one preferred embodiment, angle $\alpha$ is between 5 and 45 degrees and more preferably approximately 23 degrees, while angle $\beta$ on the leading side is between 0 and 25 degrees and more preferably approximately 12 degrees. It will be understood that radii $r_L$ and $r_T$ can be varied independently within the scope of this invention. For example, $r_L$ may be larger than $r_T$ so long as $\alpha_L$ is smaller than $\alpha_T$. This will ensure that the leading compression zone 264 is sharper than trailing tension zone 266. The invention does not require that both zones 264, 266 be rounded, or both angled to a specific degree, so long as the leading compression zone 264 is sharper than the trailing tension zone 266.

Insert 200 optionally includes a pair of marks 274, 276 on cutting surface 268, which align with the projection 22*a* of the cone axis. Marks 274, 276 serve as a visual indication of the correct orientation of the insert in the rolling cone cutter during manufacturing. It is preferred to include marks 274 and 276, as the asymmetry of insert 200 and its unusual orientation with respect to the projection 22*a* of the cone axis would otherwise make its proper alignment counter-intuitive and difficult. Marks 274, 276 preferably constitute small but visible grooves or notches, but can be any other suitable mark. In a preferred embodiment, marks 274 and 276 are positioned 180 degrees apart. Also, it is preferred in many applications to mount inserts 200 with axis 261*a* passing through cone axis 22; however, insert 200, (or other gage inserts 70) may also be mounted such that the insert axis does not intersect cone axis 22 and is skewed with respect to the cone axis.

A heel insert 60 presently preferred for bit 10 of the present invention is that disclosed in copending U.S. patent application Ser. No. 08/668,109 filed Jun. 21, 1996, and entitled Cutter Element Adapted to Withstand Tensile Stress which is commonly owned by the assignee of the present application, the specification of which is incorporated herein by reference in its entirety to the extent not inconsistent herewith. As disclosed in that application, heel insert 60 preferably includes a cutting surface having a relatively sharp leading portion, a relieved trailing portion, and a relatively flat wear face there between. Due to the presence of the relieved trailing portion, insert 60 is better able to withstand the tensile stresses produced as heel insert 60 acts against the formation, and in particular as the trailing portion is in engagement with the borehole wall. With other shaped inserts not having a relieved trailing portion, such tensile stresses have been known to cause insert damage and breakage, and mechanical fatigue leading to decreased life for the insert and the bit.

Despite the preference for a heel insert 60 having a relieved trailing portion as thus described, heel row inserts having other shapes and configurations may be employed in the present invention. For example, heel inserts 60 may have dome shaped or hemispherical cutting surfaces (not shown). Likewise, the heel inserts may have flat tops and be flush or substantially flush with the heel surface 44 as shown in FIG. 9. Heel inserts 60 may be chisel shaped as shown in FIG. 11. Further, due to the substantial gage holding ability provided by the inventive combination of off gage tooth 80 and gage insert 70, bit 10 of the invention may include a heel surface 44 in which no heel inserts are provided as shown in FIGS. 10, 12A and 12B.

Figure 16:
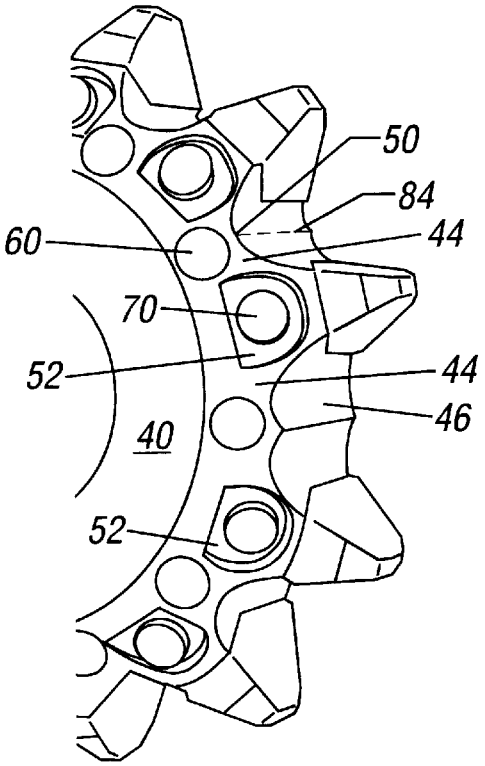
FIG. 16 is a partial perspective view of an alternative embodiment of the present invention.
Figure 17:
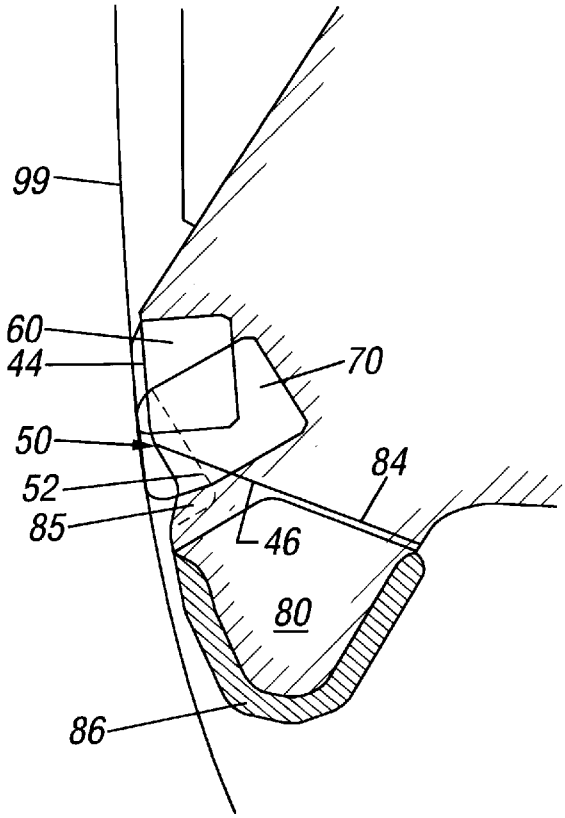
FIG. 17 is a partial section view taken through the rolling cone cutter shown in FIG. 16.

As previously described, for certain sized bits, cones 14–16 are constructed so as to include frustoconical transition surface 45 between heel surface 44 and the bottom hole facing conical surface 46. An alternative embodiment of the invention is shown in FIGS. 16 and 17. As shown therein, cone 14 is manufactured without the continuous frustoconical transition surface 45 for supporting gage inserts 70. Instead, in this embodiment, heel surface 44 and conical surface 46 are adjacent to one another and generally intersect along circumferential shoulder 50, with gage inserts 70 being mounted in lands 52 which generally are formed partly in the heel surface 44 and partly into the root region 83 of tooth 80. In this and similar embodiments, the discrete lands 52 themselves serve as the transition surface, but one that is discontinuous as compared to transition surface 45 of FIG. 5. It is presently believed that this arrangement and structure is advantageous where heel inserts 60 of substantial diameter are desired. As shown, gage inserts 70 of this embodiment are positioned behind and aligned with each tooth 80, while heel inserts 60 are alternately disposed between gage inserts 70 and lie between steel teeth 80 where they are aligned with the root 84 (FIG. 16) between adjacent teeth 80. So constructed, each land 52 is partially formed in root region 83 of tooth 80 (FIG. 17).

Figure 18:
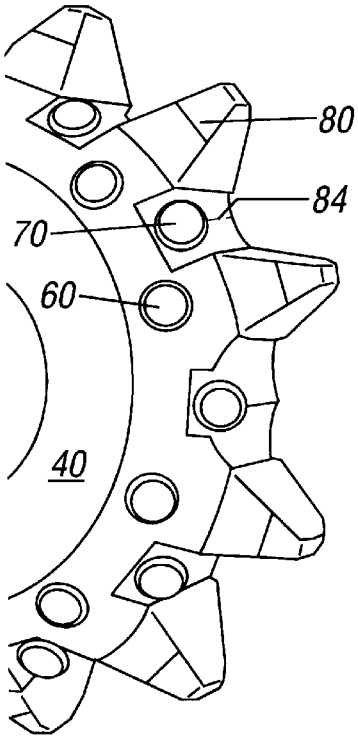
FIG. 18 is a partial perspective view of an alternative embodiment of the present invention.
Figure 19:
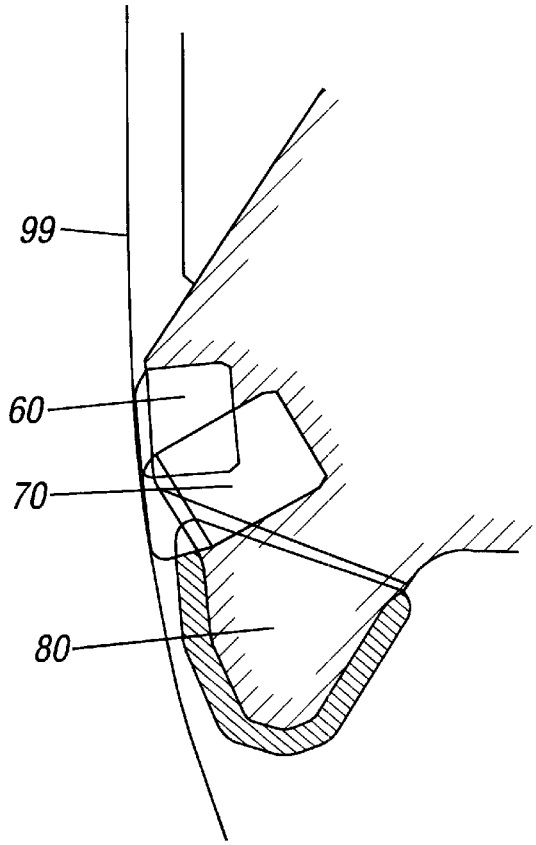
FIG. 19 is a partial section view taken through the rolling cone cutter shown in FIG. 18.

A similar embodiment is shown in FIGS. 18 and 19 in which the gage inserts 70 are positioned between teeth 80 adjacent to root 84 and where heel inserts 60 are disposed behind each tooth 80. This arrangement of inserts 60, 70 is advantageous in situations where it is undesirable to mill or otherwise form relatively deep lands 52 in teeth 80 for mounting gage inserts 70 (FIGS. 16 and 17) such as where teeth 80 are relatively narrow or short, or where forming such lands may have the tendency to weaken tooth 80. Because heel inserts 60 are further from teeth 80 than gage inserts 70, in the embodiment of FIGS. 18 and 19 they may be mounted on the heel surface 44 without the need to remove any material from behind teeth 80.

Figure 20:
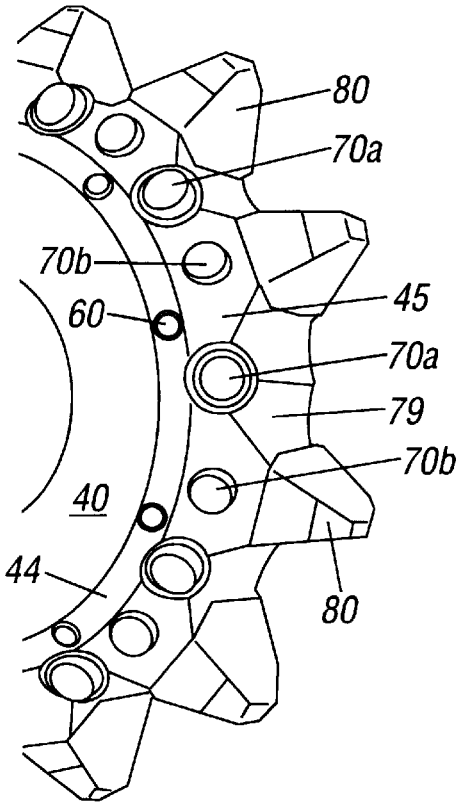
FIG. 20 is a partial perspective view of an alternative embodiment of the present invention.
Figure 21:
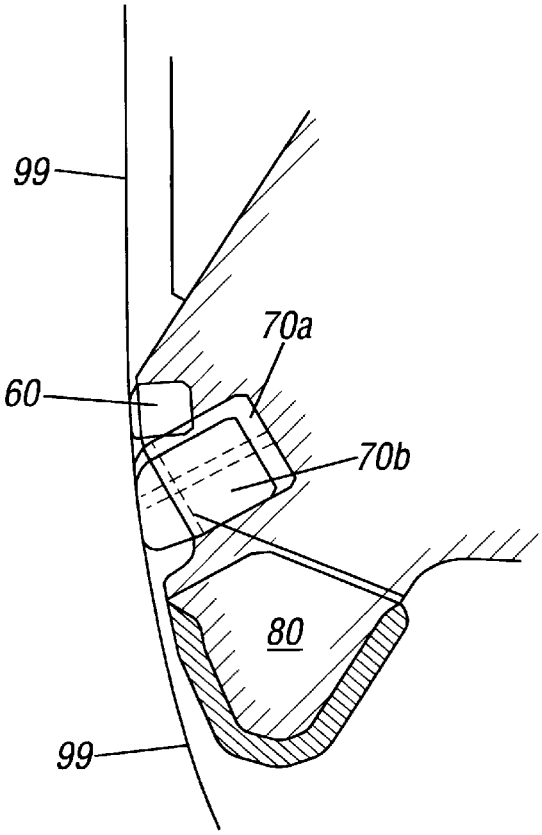
FIG. 21 is a partial section view taken through the rolling cone cutter shown in FIG. 20.

Another alternative embodiment of the invention is shown in FIGS. 20 and 21. This embodiment is similar to that described above with reference to FIGS. 3–8 in that gage inserts 70 are positioned both between the off gage teeth 80 and behind each tooth 80. In this embodiment, however, bit 10 includes differing sized gage inserts 70*a*, 70*b*, gage inserts 70*a* being larger in diameter than inserts 70*b* but both extending to gage curve 99 as shown in FIG. 21. Gage inserts 70*a* are positioned along transition surface 45 between teeth 80 while inserts 70*b*, also positioned along transition surface 45, are positioned in alignment with and behind teeth 80. By way of example, inserts 70*a* may be ⅜ inch diameter and 70*b* may be 5/16 inch diameter for a 7⅞ inch bit 10. Unlike the embodiment of FIGS. 16, 17, positioning smaller inserts 70 behind teeth 80 does not require milling or otherwise forming relatively large or deep lands 52 which might weaken the tooth 80. Depending on the sizes of the inserts 70*a*, 70*b* and their size relative to the size of cone 14, inserts 70*a*, 70*b* may be mounted such that the inserts axes are aligned or angularly skewed, or they may be parallel but slightly offset from one another as shown in FIG. 21.

Although depicted and described above as hard metal inserts, the gage row cutter elements may likewise be steel teeth formed of the parent metal of the cone 14, or they may be hard metal extensions that are applied to the cone steel after cone 14 is otherwise formed, for example by means of known hardfacing techniques. One such embodiment is shown in FIG. 22A in which bit 10 includes first inner row teeth 80 having knees 90 as previously described, and also includes steel teeth 140 behind each tooth 80 that extend to full gage. Optionally, as shown in FIG. 22A, bit 10 may also include hard metal inserts 70 as previously described positioned between each tooth 140. Steel teeth 140 have generally planar wear surfaces 142 and relatively sharp edges 144 which cooperate to cut the borehole corner in concert with knees 90 of teeth 80 (along with gage inserts 70 when such inserts are desired, it being understood that in many less abrasive formations, inserts 70 would not be necessary). Although surfaces 142 are actually portions of what would be a frustoconical surface if the wear faces 142 on spaced apart teeth 140 were interconnected, they may fairly be described as generally planar due to their relatively small curvature between edges 144.

FIG. 22B shows another embodiment of the invention similar to that described with reference to FIG. 22A. In the embodiment of FIG. 22B, wear surface 142 comprises generally planar leading region 146 and a trailing region 148 which intersect at corner 149. Leading region 146 extends to full gage so as to assist in borehole reaming. Trailing region 148 is inclined away from leading region 146 and from gage so as to relieve the trailing region 148 from stress inducing forces applied during sidewall cutting.

Figure 2A:
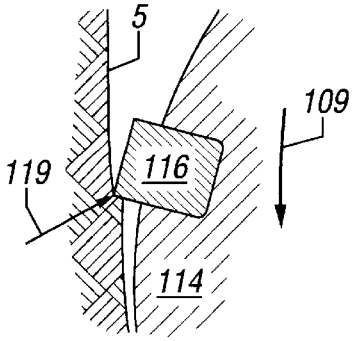
FIGS. 2 A–C are schematic plan views of a portion of the prior art cone cutter of FIG. 1 showing a heel row insert in three different positions as it engages the borehole wall.
Figure 2B:
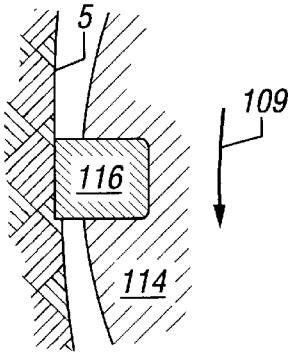
Figure 2C:
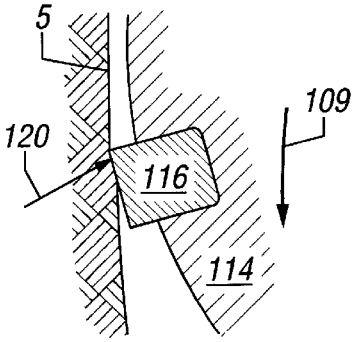
Figure 23:
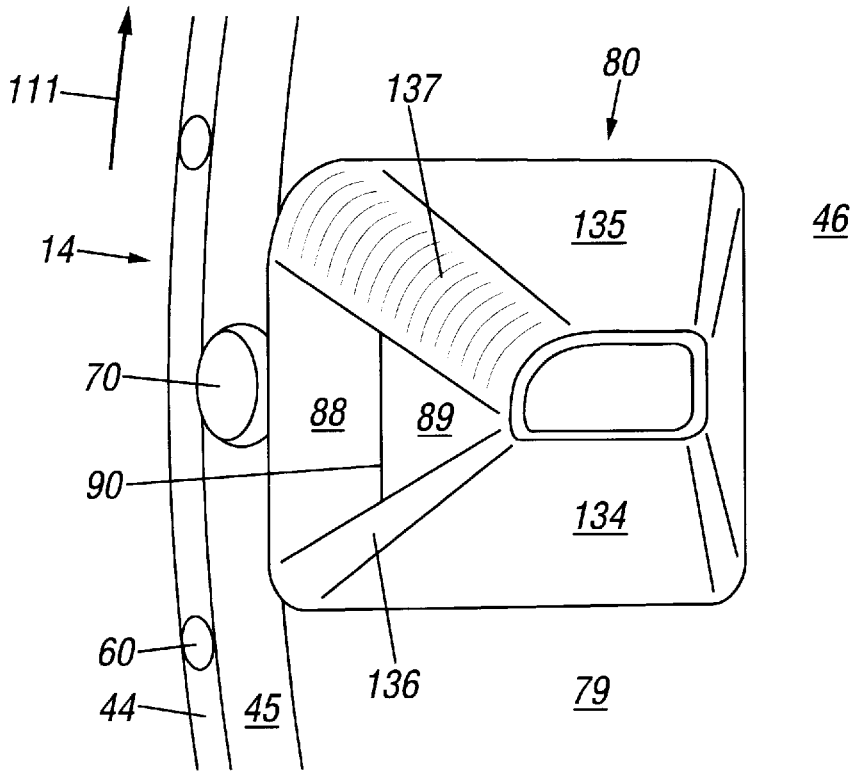
FIG. 23 is a partial perspective view of an alternative steel tooth embodiment of the present invention.

As previously discussed with respect to FIG. 2, the trailing edges of cutter elements, whether hard metal inserts or steel teeth, tend to fail more rapidly due to the high tensile stresses experienced in the direction of cutting movement. Accordingly, to increase the durability of a steel tooth, it is desirable to make the trailing edge of the tooth less sharp than the leading edge. Referring to FIG. 23, this may be accomplished by increasing the radius of curvature along the trailing edge 137. As shown, trailing edge 137 has a substantially larger radius of curvature than sharper leading edge 136. Relieving the trailing edge 137 in this manner significantly reduces the tensile stressed induced in the trailing portion of outer gage facing surface 87. Relief on trailing edge 137 may also be accomplished by forming a chamfer along the trailing edge 137, or even by canting the tooth such that the outer gage facing surface 87 is closer to the borehole wall at the leading edge 136 than at the trailing edge 137. Rounding off the trailing edge, forming a chamfer or canting the gage facing surface 87 as described above significantly reduces the tensile stresses produced in the trailing portions of the tooth. This feature, in combination with varying the hardfacing materials between the leading and trailing edges and regions as previously described is believed to offer significant advantages in bit durability. For example, referring again to FIG. 8A, the trailing edge 137 of tooth 80 may have a large radius of curvature as compared to the radius of curvature along leading edge 136. Alternatively, the trailing edge 137 may be chamfered along its entire length or, because lower portion 89 is further off gage than the upper portion 88, it may be desirable to form a chamfer on only the upper portion 88.

While various preferred embodiments of the invention have been shown and described, modifications thereof can be made by one skilled in the art without departing from the spirit and teachings of the invention. The embodiments described herein are exemplary only, and are not limiting. Many variations and modifications of the invention and apparatus disclosed herein are possible and are within the scope of the invention. Accordingly, the scope of protection is not limited by the description set out above, but is only limited by the claims which follow, that scope including all equivalents of the subject matter of the claims.

What is claimed is:

1. A steel tooth bit for cutting a borehole in accordance to a gage curve, the bit having a bit axis and comprising:

at least one rolling cone cutter having a cone axis, a heel surface generally facing the borehole sidewall, and a conical surface generally facing the borehole bottom;

gage row cutter elements disposed in a circumferential gage row on said cone cutter in a region between said heel surface and said conical surface and having cutting surfaces that extend to full gage;

steel teeth disposed in a circumferential first inner row on said cone cutter;

wherein a plurality of said steel teeth include a gage facing surface and a cutting tip that is off the gage curve a first predetermined distance for cutting the borehole bottom, and a knee on said gage facing surface for cooperatively cutting the corner of the borehole in concert with said gage row cutter elements.

2. The bit according to claim 1 wherein said knee is off the gage curve a second predetermined distance that is less than said first predetermined distance.

3. The bit according to claim 2 wherein said first predetermined distance is at least 1½ times said second predetermined distance.

4. The bit according to claim 1 wherein said teeth have an effective tooth height H as measured perpendicular to the cone axis, and wherein said knee is disposed on said gage facing surface a distance $L_2$ from said cutting tip, $L_2$ measured parallel to the bit axis and being equal to at least ¼ of the effective tooth height H.

5. The bit according to claim 1 wherein said teeth have an effective tooth height H as measured perpendicular to the cone axis, and wherein said gage row cutter elements include cutting surfaces and wherein, said knee is positioned on said gage facing surface a distance $L_1$ from the point at the lowermost edge of the portion of said cutting surface contacting the gage curve, $L_1$ being measured parallel to the bit axis, $L_1$ and being not greater than ¾ of the effective tooth height H.

6. The bit according to claim 1 wherein said teeth further comprise a root region, and wherein said gage facing surface includes an upper portion between said knee and said root region and a lower portion between said knee and said cutting tip, and wherein said lower portion is inclined radially inwardly from said knee toward the bit axis at an incline angle of at least 10 degrees.

7. The bit of claim 6 wherein said upper portion of said gage facing surface of said teeth inclines radially inwardly from said knee toward the bit axis at an incline angle of at least 10 degrees.

8. The bit according to claim 6 wherein said upper and lower portions of said gage facing surface of said teeth intersect at an angle of inclusion that is not greater than 170 degrees.

9. The bit according to claim 1 wherein said teeth further comprise a root region, and wherein said gage facing surface includes an upper portion between said knee and said root region having a radius of curvature R2, and a lower portion between said knee and said cutting tip having a radius of curvature R1, and wherein R2 is greater than R1.

10. The bit according to claim 1 wherein said teeth further comprise a root region, and wherein said gage facing surface includes a lower portion between said knee and said cutting tip having a radius of curvature R1 and an upper portion between said knee and said root region having a radius of curvature R2, and wherein R2 is substantially equal to R1.

11. The bit according to claim 1 wherein said teeth further comprise a hard metal insert having a base portion mounted in said gage facing surface and a cutting surface extending from said base and forming said knee.

12. The bit according to claim 1 wherein said knee comprises a protrusion of hardmetal material.

13. The bit according to claim 1 wherein said teeth further comprise a leading edge and a trailing edge, wherein said leading edge is sharper than said trailing edge.

14. The bit according to claim 1 wherein said teeth further comprise a leading edge, a trailing edge, and a root region, and wherein said gage facing surface includes an upper portion between said knee and said root region and a lower portion between said knee and said cutting tip, and wherein said leading edge of said upper portion is sharper than said trailing edge of said upper portion.

15. The bit according to claim 1 wherein said teeth further comprise a leading edge, a trailing edge, and a root region, and wherein said gage facing surface includes an upper portion between said knee and said root region and a lower portion between said knee and said cutting tip, and wherein said leading edge of said lower portion is sharper than said trailing edge of said lower portion.

16. The bit according to claim 1 wherein said cone cutter is made of a parent metal and wherein said gage row cutter elements comprise steel teeth made from said same parent metal as said cone.

17. The bit according to claim 16 wherein said gage row cutter elements comprise hardfacing material applied to said parent metal.

18. The bit according to claim 1 wherein said gage row cutter elements comprise hard metal inserts having a longitudinal axis and a cutting surface that includes a wear face, a leading face, a leading compression zone and a trailing tension zone, wherein said leading compression zone is sharper than said trailing tension zone.

19. The bit according to claim 18 wherein substantially all of said wear face follows the contour of the gage curve when viewed in rotated profile.

20. The bit according to claim 19 wherein said wear face of said gage cutter element is substantially flat and inclined with respect to a plane that is perpendicular the longitudinal axis.

21. The bit according to claim 20 wherein said wear face of said gage cutter elements is inclined at an angle of between 5 and 45 degrees.

22. The bit according to claim 20 wherein said leading face of said gage cutter element is substantially frustoconical.

23. The bit according to claim 19 wherein said leading face of said gage cutter element defines an angle of between 0 and 25 degrees with the longitudinal axis.

24. The bit according to claim 18 wherein said cone has a cone axis and wherein said leading compression zone has a center and a radial line through said center lies approximately 10 to 55 degrees from a projection of the cone axis onto a plane perpendicular to the bit axis when said cutter element is at its furthermost point from the hole bottom.

25. The bit according to claim 18 wherein said cutting surface of said gage cutter element is free of non-tangential intersections.

26. The bit according to claim 1 wherein said knee is positioned so as to be on the gage curve.

27. The bit according to claim 1 wherein said gage row cutter elements include a first plurality of hard metal inserts of a first diameter and a second plurality of hard metal inserts of a second diameter that is smaller than said first diameter.

28. The bit according to claim 27 wherein said inserts of said second diameter are spaced between said inserts of said first diameter in said circumferential gage row.

29. A steel tooth bit having a predetermined gage diameter for cutting a borehole according to a gage curve, the bit comprising:

a bit body having a bit axis;

at least one rolling cone cutter rotatably mounted about a cone axis on said bit body, said cutter having a heel surface generally facing the borehole side wall, a generally conical surface facing said borehole bottom, and a transition surface between said heel surface and said conical surface;

a plurality of gage cutter elements mounted on said transition surface in a circumferential gage row, said gage cutter elements having cutting surfaces that cut to full gage;

a circumferential first inner row of steel teeth on said cone cutter, wherein said steel teeth comprise:

a root region;

a cutting tip spaced from said root region;

a gage facing surface between said root region and said cutting tip;

a knee on said gage facing surface;

wherein said cutting tip is off the gage curve a first predetermined distance when said tooth is at its closest approach to the gage curve.

30. The bit according to claim 29 wherein said transition surface is a frustoconical surface.

31. The bit according to claim 29 wherein said transition surface is segmented.

32. The bit according to claim 29 wherein the gage diameter of the bit is less than or equal to 7 inches, and wherein said knee is off the gage curve a predetermined distance D and said cutting tip is off the gage curve a predetermined distance of at least 1½ D, and wherein D is within the range of 0.015–0.150 inch.

33. The bit according to claim 29 wherein the gage diameter of the bit is greater than 7 inches and less than or equal to 10 inches, and wherein said knee is off the gage curve a predetermined distance D and said cutting tip is off the gage curve a predetermined distance of at least 1½ D, and wherein D is within the range of 0.020–0.200 inch.

34. The bit according to claim 29 wherein the gage diameter of the bit is greater than 10 inches and less than or equal to 15 inches, and wherein said knee is off the gage curve a predetermined distance D and said cutting tip is off the gage curve a predetermined distance of at least 1½ D, and wherein D is within the range of 0.025–0.250 inch.

35. The bit according to claim 29 wherein the gage diameter of the bit is greater than 15 inches, and wherein said knee is off the gage curve a predetermined distance D and said cutting tip is off the gage curve a predetermined distance of at least 1½ D, and wherein D is within the range of 0.030–0.300 inch.

36. The bit according to claim 29 wherein said cutting surfaces of said gage cutter elements comprise a leading face, a trailing face and a wear face; and wherein an interface between said leading face and said wear face forms a leading compression zone and an interface between said trailing face and said wear face forms a trailing tension zone; and wherein said leading compression zone is sharper than said trailing tension zone.

37. The bit according to claim 36 wherein substantially all of said wear face follows the contour of the gage curve when viewed in rotated profile.

38. The bit according to claim 37 wherein said wear face of said gage cutter elements is substantially flat and inclined with respect to a plane that is perpendicular to the longitudinal axis.

39. The bit according to claim 36 wherein said leading face of said gage cutter elements is substantially frustoconical.

40. The bit according to claim 37 wherein said leading face of said gage cutter elements defines an angle of between 0 and 25 degrees with the longitudinal axis.

41. The bit according to claim 36 wherein said cone has a cone axis and wherein said leading compression zone of said gage cutter elements has a center and a radial line through said center lies approximately 10 to 55 degrees from a projection of the cone axis onto a plane perpendicular to the bit axis when said cutter element is at its furthermost point from the hole bottom.

42. The bit according to claim 36 wherein said cutting surface of said gage cutter element is free of non-tangential intersections.

43. The bit of claim 36 wherein said knee is off the gage curve a predetermined distance and wherein said gage row cutter elements and said knee cooperate to cut the corner of the borehole.

44. The bit according to claim 43 wherein said teeth have an effective tooth height H as measured perpendicular to the cone axis, and wherein said knee is positioned on said gage facing surface a distance $L_1$ from the point at the lowermost edge of said wear face as viewed in rotated profile, $L_1$ being measured parallel to the bit axis and being not greater than ¾ H.

45. The bit according to claim 43 wherein said teeth have an effective tooth height H as measured perpendicular to the cone axis, and wherein said knee is disposed on said gage facing surface a distance $L_2$ from said cutting tip, $L_2$ being measured parallel to the bit axis and being equal to at least ¼ H and not greater than ¾ H.

46. The bit according to claim 36 wherein said teeth further comprise a hard metal insert having a base portion mounted in said gage facing surface and a cutting surface extending from said base and forming said knee.

47. The bit according to claim 36 wherein said knee comprises a protrusion of hardmetal material.

48. The bit according to claim 36 wherein said teeth further comprise a leading edge, a trailing edge, and a root region, and wherein said gage facing surface includes an upper portion between said knee and said root region and a lower portion between said knee and said cutting tip, and wherein said leading edge of said upper portion is sharper than said trailing edge of said upper portion.

49. The bit according to claim 36 wherein said teeth further comprise a leading edge, a trailing edge, and a root region, and wherein said gage facing surface includes an upper portion between said knee and said root region and a lower portion between said knee and said cutting tip, and wherein said leading edge of said lower portion is sharper than said trailing edge of said lower portion.

50. A steel tooth bit having a predetermined gage diameter for cutting a borehole according to a gage curve, the bit comprising:

a bit body having a bit axis;

at least one rolling cone cutter rotatably mounted on said bit body, said cutter having a heel surface generally facing the borehole side wall, a generally conical surface facing said borehole bottom, and a transition surface between said heel surface and said conical surface;

a plurality of gage cutter elements positioned on said cone cutter in a first circumferential gage row, said gage cutter elements having cutting surfaces that cut to full gage;

a first inner row of steel teeth on said cone cutter, wherein said steel teeth include:

a root region;

a cutting tip spaced from said root region;

a gage facing surface between said root region and said cutting tip;

a knee on said gage facing surface;

wherein said cutting tip is off the gage curve a first predetermined distance and said knee is off the gage curve a second predetermined distance that is less than said first predetermined distance when said tooth is at its closest approach to the gage curve.

51. The bit according to claim 50 wherein said teeth have an effective tooth height H as measured perpendicular to the cone axis, and wherein said gage cutter elements include a cutting surface, and wherein said knee is positioned on said gage facing surface a distance $L_1$ from the lower most point of the portion of said cutting surface of said gage cutter element that contacts the gage curve, $L_1$ being measured parallel to the bit axis and being not greater than ¾ of the effective tooth height H.

52. The bit according to claim 51 wherein said first predetermined distance is at least 1½ times said second predetermined distance.

53. The bit according to claim 52 wherein said gage cutter elements are hard metal inserts having a leading compression zone and a trailing tension zone and wherein said leading compression zone is sharper than said trailing tension zone.

54. The bit according to claim 52 wherein said gage cutter elements comprise steel teeth having a leading edges that are sharper than their trailing edges.

55. The bit according to claim 52 wherein said tooth includes at least two hardfacing materials on said gage facing surface where said hardfacing materials have differing abrasive wear characteristics.

56. The bit according to claim 52 wherein said first circumferential row of gage cutter elements include a first plurality of hard metal inserts having a first diameter and a second plurality of hard metal inserts having a second diameter larger than said first diameter.

57. The bit according to claim 56 wherein said inserts having said larger diameter are aligned with said teeth.

58. The bit according to claim 56 wherein said inserts having said larger diameter are disposed between said teeth.

59. A steel tooth bit having a bit axis for cutting a borehole in accordance to a gage curve, the bit having a bit axis and comprising:

a rolling cone cutter having a nose portion and a backface;

a first row of cutter elements disposed in a circumferential row on said cone cutter and having cutting surfaces that extend to full gage;

steel teeth disposed in a circumferential second row on said cone cutter, said second row being disposed between said first row and said nose portion;

wherein a plurality of said steel teeth include a cutting tip that is off the gage curve a first predetermined distance for cutting the borehole bottom, and a knee that is off the gage curve a second predetermined distance that is less than said first predetermined distance for cooperatively cutting the corner of the borehole in concert with said cutter elements of said first row.

60. The bit according to claim 59 wherein said cutting surfaces of said cutter elements of said first row comprise a leading face, a trailing face and a wear face, and wherein an interface between said leading face and said wear face forms a leading compression zone and an interface between said trailing face and said wear face forms a trailing tension zone; and wherein said leading compression zone is sharper than said trailing tension zone.

61. The bit according to claim 60 wherein said cone cutter further comprises a heel surface generally facing the borehole sidewall and a generally conical surface facing the borehole bottom, and a transition surface between said heel surface and said conical surface; wherein said cutter elements of said first row are disposed on said transition surface.

62. The bit according to claim 61 wherein said transition surface is segmented.

63. The bit according to claim 60 wherein said cone has a cone axis and said leading compression zone has a center and wherein a radial line through said center lies approximately 10 to 55 degrees from a projection of the cone axis onto a plane perpendicular to the bit axis when said cutter element is at its furthermost point from the hole bottom.

64. The bit according to claim 59 wherein said rolling cone cutter includes a heel surface and an adjacent conical surface and a circumferential shoulder therebetween; and wherein said cutter elements of said first row are disposed on said shoulder.

65. The bit according to claim 59 wherein said rolling cone cutter includes a heel surface generally facing the borehole sidewall and a conical surface generally facing the borehole bottom and wherein said first row of cutter elements are disposed on said heel surface.

66. The bit according to claim 59 wherein said rolling cone cutter includes a heel surface generally facing the borehole sidewall and a conical surface generally facing the borehole bottom and wherein said first row of cutter elements are disposed in a region between said heel surface and said conical surface.

* * * * *